US008852839B2

(12) United States Patent
Chonan et al.

(10) Patent No.: US 8,852,839 B2
(45) Date of Patent: Oct. 7, 2014

(54) POLYESTER FOR TONER, ELECTROSTATIC-IMAGE DEVELOPING TONER, ELECTROSTATIC-IMAGE DEVELOPER, TONER CARTRIDGE, PROCESS CARTRIDGE, IMAGE-FORMING APPARATUS, AND IMAGE-FORMING METHOD

(71) Applicant: Fuji Xerox Co., Ltd., Tokyo (JP)

(72) Inventors: Shiori Chonan, Kanagawa (JP); Sumiaki Yamasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/890,586

(22) Filed: May 9, 2013

(65) Prior Publication Data

US 2014/0106271 A1 Apr. 17, 2014

(30) Foreign Application Priority Data

Oct. 16, 2012 (JP) ..... 2012-229315

(51) Int. Cl.
*G03G 9/087* (2006.01)

(52) U.S. Cl.
CPC ..... *G03G 9/08755* (2013.01)
USPC ..... 430/109.4

(58) Field of Classification Search
CPC ..... G03G 9/08755; G03G 9/08797; G03G 9/08795
USPC ..... 430/109.4
See application file for complete search history.

(56) References Cited

U.S. PATENT DOCUMENTS

| | | | |
|---|---|---|---|
| 2004/0152813 | A1 | 8/2004 | Shirai |
| 2010/0136471 | A1 | 6/2010 | Yamada et al. |

FOREIGN PATENT DOCUMENTS

| | | |
|---|---|---|
| JP | A-61-188545 | 8/1986 |
| JP | A-08-020636 | 1/1996 |
| JP | A-10-239903 | 9/1998 |
| JP | A-11-133668 | 5/1999 |
| JP | A-2004-226569 | 8/2004 |
| JP | A-2007-292818 | 11/2007 |
| JP | A-2007-322926 | 12/2007 |
| JP | A-2008-122510 | 5/2008 |
| JP | A-2010-152291 | 7/2010 |

*Primary Examiner* — Hoa V Le
(74) *Attorney, Agent, or Firm* — Oliff PLC

(57) ABSTRACT

Provided is a polyester being a polymer including a dicarboxylic acid, a rosin diol, and an epoxy compound, the rosin diol being represented by general formula (1):

(1)

wherein $R^1$ and $R^2$ are independently hydrogen or methyl; $L^1$, $L^2$, and $L^3$ are independently a divalent linking group selected from the group consisting of carbonyl, ester, ether, sulfonyl, optionally substituted chain alkylenes, optionally substituted cyclic alkylenes, optionally substituted arylenes, and combinations thereof; $L^1$ and $L^2$ or $L^1$ and $L^3$ are optionally joined together to form a ring; and $A^1$ and $A^2$ are rosin ester groups.

12 Claims, 2 Drawing Sheets

POLYESTER FOR TONER, ELECTROSTATIC-IMAGE DEVELOPING TONER, ELECTROSTATIC-IMAGE DEVELOPER, TONER CARTRIDGE, PROCESS CARTRIDGE, IMAGE-FORMING APPARATUS, AND IMAGE-FORMING METHOD

CROSS-REFERENCE TO RELATED APPLICATIONS

This application is based on and claims priority under 35 USC 119 from Japanese Patent Application No. 2012-229315 filed Oct. 16, 2012.

BACKGROUND

Technical Field

The present invention relates to a polyester for a toner, an electrostatic-image developing toner, an electrostatic-image developer, a toner cartridge, a process cartridge, an image-forming apparatus, and an image-forming method.

SUMMARY

According to an aspect of the invention, there is provided a polyester being a polymer including a dicarboxylic acid, a rosin diol, and an epoxy compound, the rosin diol being represented by general formula (1):

(1)

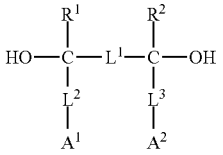

wherein $R^1$ and $R^2$ are independently hydrogen or methyl; $L^1$, $L^2$, and $L^3$ are independently a divalent linking group selected from the group consisting of carbonyl, ester, ether, sulfonyl, optionally substituted chain alkylenes, optionally substituted cyclic alkylenes, optionally substituted arylenes, and combinations thereof; $L^1$ and $L^2$ or $L^1$ and $L^3$ are optionally joined together to form a ring; and $A^1$ and $A^2$ are rosin ester groups.

BRIEF DESCRIPTION OF THE DRAWINGS

Exemplary embodiments of the present invention will be described in detail based on the following figures, wherein.

DETAILED DESCRIPTION

Figure 1:
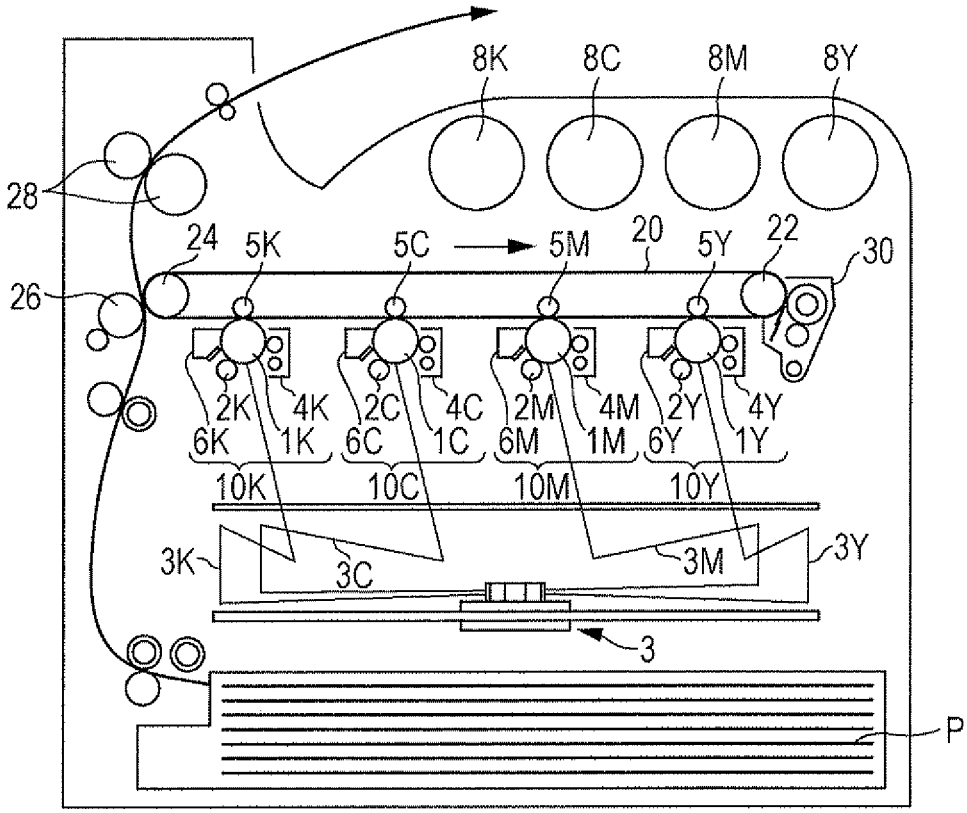
FIG. 1 is a schematic diagram illustrating an image-forming apparatus according to an exemplary embodiment.

Exemplary embodiments of the invention will now be described in detail.

Polyester for Toner

The polyester for a toner according to an exemplary embodiment is a polymer of a dicarboxylic acid, a rosin diol, and a difunctional epoxy compound, the rosin diol being represented by general formula (1):

(1)

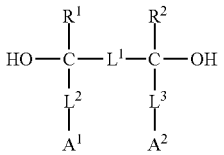

wherein $R^1$ and $R^2$ are independently hydrogen or methyl; L', $L^2$, and $L^3$ are independently a divalent linking group selected from the group consisting of carbonyl, ester, ether, sulfonyl, optionally substituted chain alkylenes, optionally substituted cyclic alkylenes, optionally substituted arylenes, and combinations thereof; $L^1$ and $L^2$ or $L^1$ and $L^3$ are optionally joined together to form a ring; and $A^1$ and $A^2$ are rosin ester groups.

The polyester for a toner according to this exemplary embodiment, having the above-described feature, may realize a wide fixing latitude.

The reason for this is unknown but presumably as follows.

The polyester according to this exemplary embodiment is a polycondensate of a dicarboxylic acid and a rosin diol represented by general formula (1), the polycondensate being crosslinked by using a difunctional epoxy compound. When the polyester according to this exemplary embodiment is crosslinked by using a difunctional epoxy compound, a polyester with a wide molecular-weight distribution, which contains polymers having various molecular weights, may be formed. In addition, when the polyester contains various polymers such as low-molecular-weight polymers and high-molecular-weight polymers, occurrences of low-temperature offset and high-temperature offset may be suppressed. The term "offset" herein refers to a phenomenon in which toner particles on a toner image are transferred to a fixing member such as a fixing roller. The term "low-temperature offset" herein refers to an offset caused by the toner particles of a toner image not being sufficiently heated. The term "high-temperature offset" herein refers to an offset caused by the toner of a toner image being overheated.

As a result, the polyester for a toner according to this exemplary embodiment may realize a wide fixing latitude compared with a polyester for a toner not having the above-described feature presumably because of suppression of the occurrence of low-temperature offset and high-temperature offset.

The reason why the fixing latitude is widened more by using the difunctional epoxy compound as a crosslinking agent than by using other crosslinking agents is presumably as follows.

At the termination of the synthesis of the rosin diol, an unreacted difunctional epoxy compound and a monofunctional epoxy compound having one end reacted with a rosin compound are present in a reactor. The monofunctional epoxy compound serves not as a crosslinking agent but as a suppressant that suppresses the growth of molecular chains. Therefore, a resin having a wider molecular-weight distribution may be formed, which widens the fixing latitude.

The polyester according to this exemplary embodiment may have a wide molecular-weight distribution without mixing resins having various molecular weights such as low-molecular-weight resins and high-molecular-weight resins therein. Even when such resins are mixed in the polyester, the amount of resins mixed may be reduced. This improves the productivity of a toner.

The polyester for a toner according to this exemplary embodiment may be a polymer formed by reacting a rosin compound with an excessive amount of a difunctional epoxy compound to prepare a mixture of a rosin diol represented by general formula (1) and the remaining difunctional epoxy compound and subsequently polymerizing the mixture and a dicarboxylic acid.

The polyester for a toner according to this exemplary embodiment, which is synthesized by using an excessive amount of difunctional epoxy compound at the synthesis of the rosin diol, may have further widen fixing latitude.

The reason why the fixing latitude is widened is presumably as follows. At the termination of the synthesis of the rosin diol, an unreacted difunctional epoxy compound and a monofunctional epoxy compound having one end reacted with a rosin compound are present in a reactor. The monofunctional epoxy compound serves not as a crosslinking agent but as a suppressant that suppresses the growth of molecular chains. Therefore, a resin having a wider molecular-weight distribution may be formed, which widens the fixing latitude.

Ratio of Rosin Compound to Difunctional Epoxy Compound

The ratio of the rosin compound to the difunctional epoxy compound that are used for synthesizing the rosin diol represented by general formula (1) is such that the amount of the difunctional epoxy compound is preferably 1.01 moles or more and 1.2 moles or less or about 1.01 moles or more and about 1.2 moles or less, more preferably 1.03 moles or more and 1.15 moles or less, and further preferably in the range of 1.05 moles or more and 1.1 moles or less, relative to 2 moles of rosin compound.

When the amount of difunctional epoxy compound is 1.01 moles or more or about 1.01 moles or more relative to 2 moles of rosin compound, the fixing latitude may be widened. When the amount of difunctional epoxy compound is 1.2 moles or less or about 1.2 moles or less relative to 2 moles of rosin compound, the crosslinking is prevented from excessively advancing and as a result the glass transition temperature of the resin does not exceed a temperature range appropriate for forming toner.

Alternatively, the polyester for a toner according to this exemplary embodiment may be produced by reacting a rosin compound and a proper amount of difunctional epoxy compound to form a rosin diol represented by general formula (1) and subsequently mixing the rosin diol with a difunctional epoxy compound serving as a crosslinking agent and a dicarboxylic acid to form a polymer.

Molecular-Weight Distribution (Mw/Mn)

In the polyester for a toner according to this exemplary embodiment, the molecular-weight distribution (Mw/Mn) calculated from the weight-average molecular weight Mw and number-average molecular weight Mn is preferably 12 or more or about 12 or more, more preferably 12.5 or more and 20 or less, and further preferably 14 or more and 18 or less.

The polyester for a toner according to this exemplary embodiment, having a molecular-weight distribution of 12 or more or about 12 or more, may realize a wide fixing latitude.

The weight-average molecular weight Mw and the number-average molecular weight Mn are measured with HLC-8120GPC and SC-8020 (with 2 columns of 6.0 mmID×15 cm, produced by Tosoh Corporation) using tetrahydrofuran (THF) as an eluent. The measurement conditions are as follows: sample concentration is 0.5%, flow rate is 0.6 ml/min, sample injection volume is 10 μl, temperature is 40° C., and detector is a RI detector. A calibration curve is prepared on the basis of ten samples: polystyrene standard sample TSK standard A-500, F-1, F-10, F-80, F-380, A-2500, F-4, F-40, F-128, and F-700.

The polyester for a toner according to this exemplary embodiment will now be described in detail.

Rosin Diol

In the polyester for a toner according to this exemplary embodiment, the rosin diol represented by general formula (1) is used for polymerization:

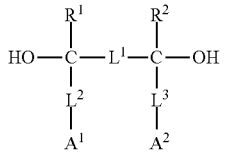

(1)

wherein $R^1$ and $R^2$ are independently hydrogen or methyl; $L^1$, $L^2$, and $L^3$ are independently a divalent linking group selected from the group consisting of carbonyl, ester, ether, sulfonyl, optionally substituted chain alkylenes, optionally substituted cyclic alkylenes, optionally substituted arylenes, and combinations thereof; $L^1$ and $L^2$ or $L^1$ and $L^3$ are optionally joined together to form a ring; and $A^1$ and $A^2$ are rosin ester groups.

The chain alkylene groups represented by $L^1$, $L^2$, and $L^3$ may each be, for example, an alkylene group having a carbon number of 1 or more and 10 or less.

The cyclic alkylene groups represented by $L^1$, $L^2$, and $L^3$ may each be, for example, a cyclic alkylene group having a carbon number of 3 or more and 7 or less.

Examples of the arylene groups represented by $L^1$, $L^2$, and $L^3$ include a phenylene group, a naphthylene group, and an anthracene group.

Examples of substituents in the chain alkylene groups, cyclic alkylene groups, and arylene groups include alkyl and aryl groups having a carbon number of 1 or more and 8 or less. Preferred are linear, branched, and cyclic alkyl groups. Specific examples thereof include a methyl group, an ethyl group, a propyl group, a butyl group, a pentyl group, a hexyl group, a heptyl group, an octyl group, an isopropyl group, an isobutyl group, a s-butyl group, a t-butyl group, an isopentyl group, a neopentyl group, a 1-methyl butyl group, an isohexyl group, a 2-ethylhexyl group, a 2-methylhexyl group, a cyclopentyl group, a cyclohexyl group, and a phenyl group.

The rosin diol represented by general formula (1) has two rosin ester groups per molecule.

In this exemplary embodiment, the term "rosin ester group" refers to a residue formed by removing a hydrogen atom from the carboxyl group of a rosin.

The rosin diol represented by general formula (1) may be synthesized by any known method, for example, by reacting a rosin with a difunctional epoxy compound.

The scheme for synthesizing the rosin diol is described below as an example.

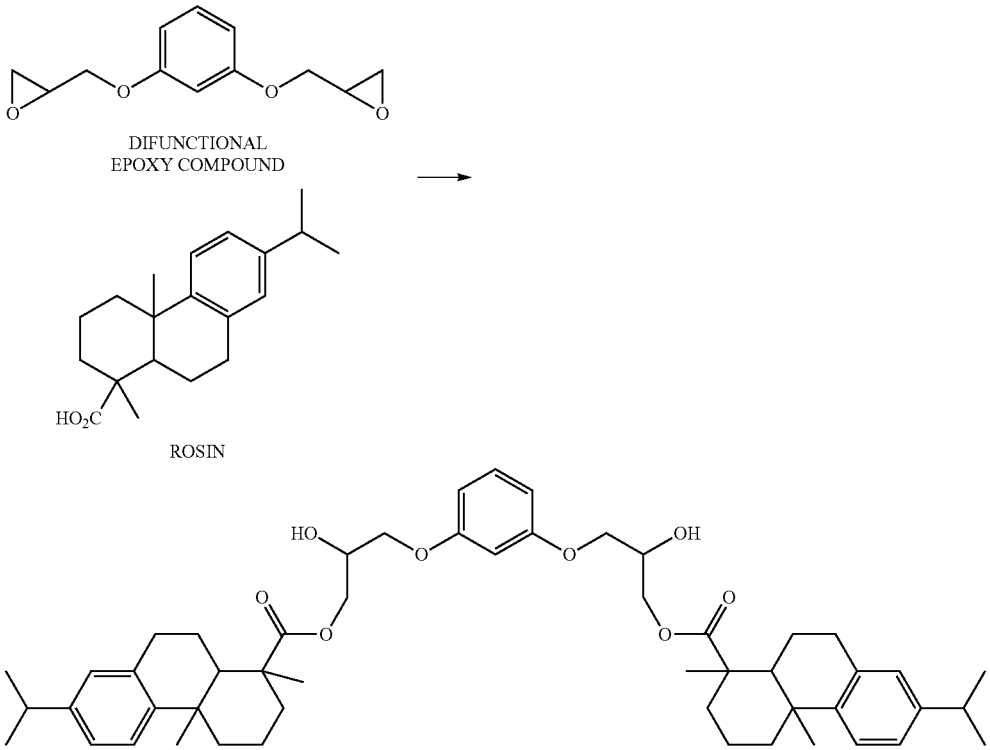

Difunctional epoxy compounds are epoxy compounds having two epoxy groups per molecule. Examples thereof include diglycidyl ethers of aromatic diols, diglycidyl ethers of aromatic dicarboxylic acids, diglycidyl ethers of aliphatic diols, diglycidyl ethers of alicyclic diols, and alicyclic epoxides.

Representative examples of the aromatic diol components of the diglycidyl ethers of aromatic diols include bisphenol A, derivatives of bisphenol A such as bisphenol A-polyalkylene oxide adducts, bisphenol F, derivatives of bisphenol F such as bisphenol F-polyalkylene oxide adducts, bisphenol S, derivatives of bisphenol S such as bisphenol S-polyalkylene oxide adducts, resorcinol, t-butylcatechol, and biphenol.

Representative examples of the aromatic dicarboxylic acid components of the diglycidyl ethers of aromatic dicarboxylic acids include terephthalic acid, isophthalic acid, and phthalic acid.

Representative examples of the aliphatic diol components of the diglycidyl ethers of aliphatic diols include ethylene glycol, 1,2-propanediol, 1,3-propanediol, 1,4-butanediol, 1,5-pentanediol, 1,6-hexanediol, neopentyl glycol, 1,9-nonanediol, diethylene glycol, triethylene glycol, polyethylene glycol, polypropylene glycol, and polytetramethylene glycol.

Representative examples of the alicyclic diol components of the diglycidyl ethers of alicyclic diols include hydrogenated bisphenol A, derivatives of hydrogenated bisphenol A such as hydrogenated bisphenol A-polyalkylene oxide adducts, and cyclohexanedimethanol.

A representative example of the alicyclic epoxides is limonene dioxide.

The epoxy compound may be prepared by, for example, reacting a diol component with epihalohydrin. Optionally, the epoxy compound may be polymerized to increase its molecular weight depending on the quantitative ratio between the diol component and epihalohydrin.

The reaction of a rosin with a difunctional epoxy compound proceeds due primarily to the ring-open reaction of a carboxyl group of the rosin and an epoxy group of the difunctional epoxy compound. The reaction temperature may be equal to or more than the melting temperatures of the two components or a temperature at which the two components may be mixed with each other. Specifically, the temperature range of 60° C. or more and 200° C. or less is common. Optionally, a catalyst may be used in order to promote the ring-open reaction of the epoxy groups.

Examples of the catalyst include amines such as ethylenediamine, trimethylamine, and 2-methylimidazole; quaternary ammonium salts such as triethylammonium bromide, triethylammonium chloride, and butyltrimethylammonium chloride; and triphenylphosphine.

The reaction may be performed using various methods. For example, in a batch process, typically, a rosin and a difunctional epoxy compound are placed into a flask that is equipped with a cooling tube, a stirrer, an inert gas inlet, a thermometer, etc. and capable of heating its contents and melted under heating, and the extent of the reaction is tracked by sampling the reactant. The extent to which the reaction has taken place is determined generally on the basis of the reduction in the acid value. The reaction is considered to be terminated at the time when the reaction reaches or substantially reaches the stoichiometric end point.

Although the reaction ratio between the rosin and the difunctional epoxy compound is not particularly limited, the amount of rosin reacted with 1 mole of difunctional epoxy compound is preferably 1.5 moles or more and 2.5 moles or less.

The term "rosin" herein is a generic name for resin acids produced from trees, and its principal components are substances of natural product origin including abietic acid, which is a kind of tricyclic diterpenes, and its isomers. Specific examples of the principal components of rosin include, in addition to abietic acid, palustric acid, neoabietic acid, pimaric acid, dehydroabietic acid, isopimaric acid, and sandaracopimaric acid. The rosin used in this exemplary embodiment is a mixture of these substances. Rosins are broadly divided into three categories on the basis of the extraction method: tall rosins extracted from pulp, gum rosins extracted from crude turpentine, and wood rosins extracted from pine stumps.

The rosin used in this exemplary embodiment may be a gum rosin and a tall rosin because of the ease of availability. These rosins may be purified. Rosins are purified by removing high-molecular substances presumably generated from peroxides of resin acids from unpurified rosins or by removing unsaponifiable matters contained in unpurified rosins. The purification method is not particularly limited and various known purification methods may be employed. Specific examples of the purification methods include distillation, recrystallization, and extraction. Purification by distillation is preferable from the industrial viewpoint. The conditions of distillation are normally at 200° C. or more and 300° C. or less and a pressure of 6.67 kPa or less and selected considering the distillation time. Recrystallization is performed by, for example, dissolving an unpurified rosin in a good solvent, subsequently distilling the solvent off to concentrate the solution, and adding a poor solvent to the solution. Examples of the good solvent include aromatic hydrocarbons such as benzene, toluene, and xylene; chlorinated hydrocarbons such as chloroform; alcohols such as lower alcohols; ketones such as acetone; and acetate esters such as ethyl acetate. Examples of the poor solvent include hydrocarbon solvents such as n-hexane, n-heptane, cyclohexane, and isooctane.

Extraction is a method in which, for example, an unpurified rosin is dissolved in alkaline water to prepare an alkaline aqueous solution, an insoluble unsaponifiable matter contained in the solution is extracted using an organic solvent, and subsequently the aqueous layer of the solution is neutralized, thus preparing a purified rosin.

In this exemplary embodiment, the rosin may be a disproportionated rosin. The disproportionated rosin is a rosin produced by heating a rosin containing abietic acid as a principal component under a disproportionation catalyst at a high temperature to eliminate unstable conjugated double bonds in molecules. The disproportionated rosin is principally composed of a mixture of dehydroabietic acid and dihydroabietic acid.

Examples of the disproportionation catalyst include supported catalysts such as palladium-carbon, rhodium-carbon, and platinum-carbon; metal powders such as nickel powder and platinum powder; iodine; iodides such as iron iodide; and phosphorus-based compounds, which are publicly known. The proportion of the catalyst in a rosin is normally 0.01% by mass or more and 5% by mass or less, and preferably 0.01% by mass or more and 1% by mass or less. The reaction temperature is 100° C. or more and 300° C. or less, and preferably 150° C. or more and 290° C. or less. Alternatively, the amount of the dehydroabietic acid added may be isolated by, for example, crystallizing dehydroabietic acid as an ethanolamine salt in a disproportionated rosin (J. Org. Chem., 31, 4246 (1966)) and used in the above-described proportion.

In this exemplary embodiment, the rosin may be a hydrogenated rosin. The hydrogenated rosin contains tetrahydroabietic acid and dihydroabietic acid as principal components and is formed by eliminating unstable conjugated double bonds in the molecule due to known hydrogenation reaction. The hydrogenation reaction is performed by heating an unpurified rosin in the presence of a hydrogenation catalyst at a hydrogen pressure of normally 10 kg/cm$^2$ or more and 200 kg/cm$^2$ or less and preferably 50 kg/cm$^2$ or more and 150 kg/cm$^2$ or less. Examples of the hydrogenation catalyst include supported catalysts such as palladium-carbon, rhodium-carbon, and platinum-carbon; metal powders such as nickel powder and platinum powder; iodine; and iodides such as iron iodide, which are publicly known. The proportion of the catalyst in a rosin is normally 0.01% by mass or more and 5% by mass or less, and preferably 0.01% by mass or more and 1.0% by mass or less. The reaction temperature is 100° C. or more and 300° C. or less and preferably 150° C. or more and 290° C. or less.

These disproportionated rosin and hydrogenated rosin may be optionally subjected to the above-described purification process before or after the disproportionation process or hydrogenation process.

In this exemplary embodiment, the rosin may be a polymerized rosin produced by polymerization of a rosin, an unsaturated carboxylic acid-modified rosin produced by adding an unsaturated carboxylic acid to a rosin, or a phenol-modified rosin. Examples of the unsaturated carboxylic acid used for preparing the unsaturated carboxylic acid-modified rosin include maleic acid, maleic anhydride, fumaric acid, acrylic acid, and methacrylic acid. The unsaturated carboxylic acid-modified rosin is a rosin modified with an unsaturated carboxylic acid in an amount of normally about 1 part by mass or more and about 30 parts by mass or less relative to 100 parts by weight of raw material rosin.

Among these rosins, the rosin used in this exemplary embodiment is preferably a purified rosin, a disproportionated rosin, and a hydrogenated rosin, which may be used alone or in mixture.

Shown below are the exemplary compounds of the rosin diol represented by general formula (1) that may be used in this exemplary embodiment. However, the rosin diol is not limited to these exemplary compounds.

(1)

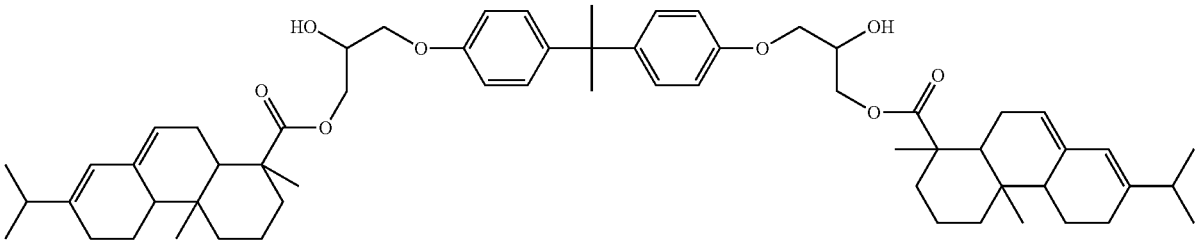

-continued
(2)
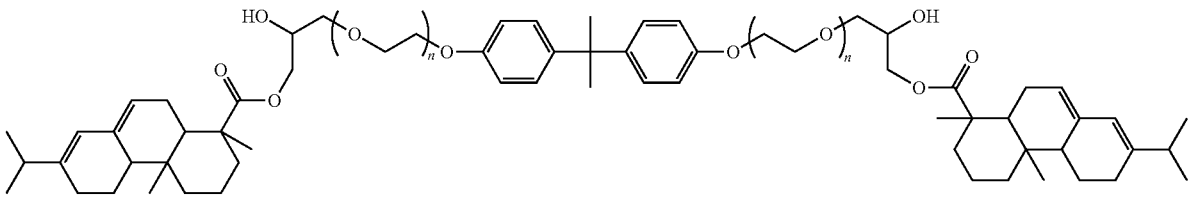
(3)
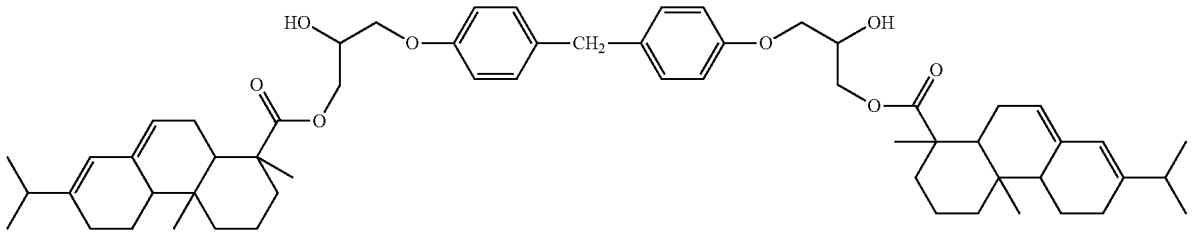
(4)
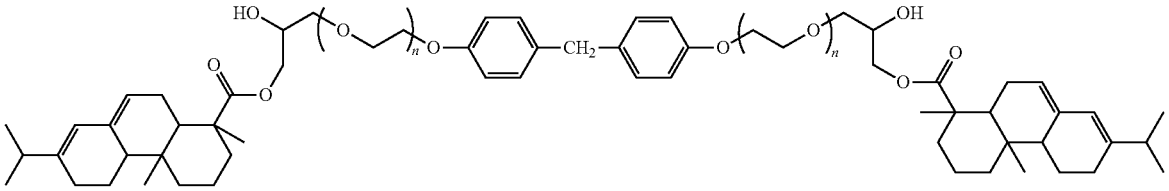
(5)
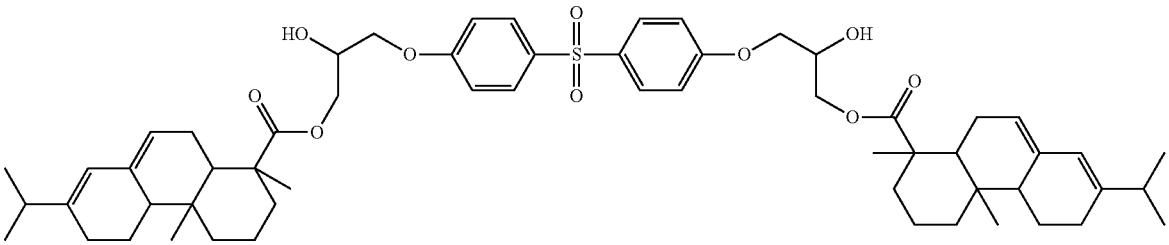
(6)
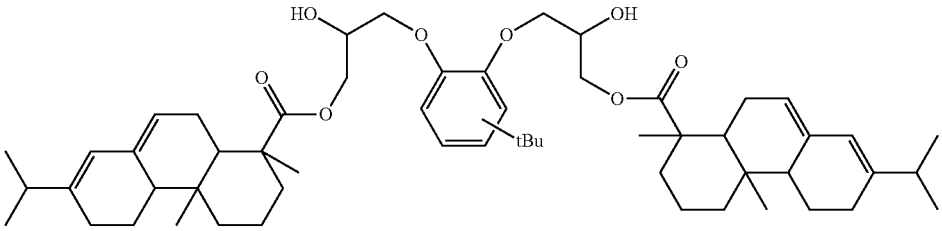
(7)
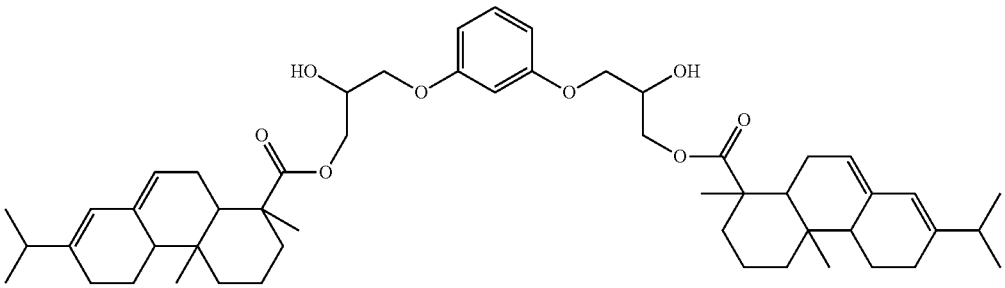

-continued
(8)
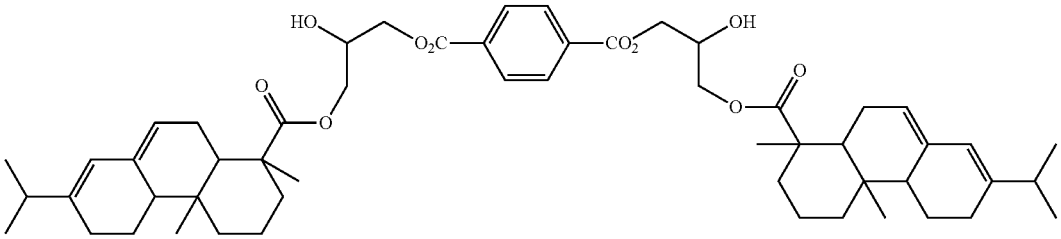
(9)
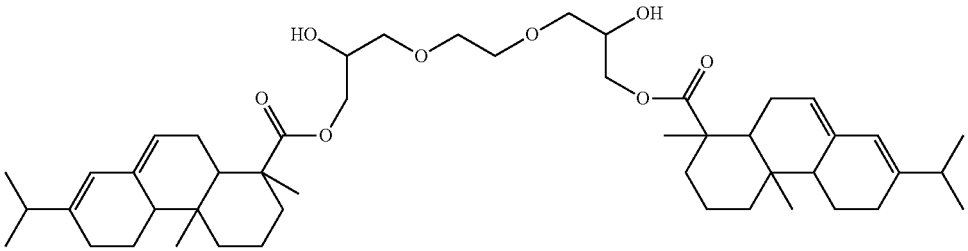
(10)
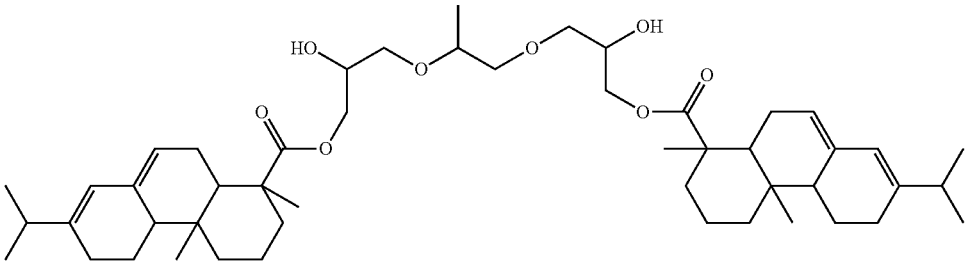
(12)
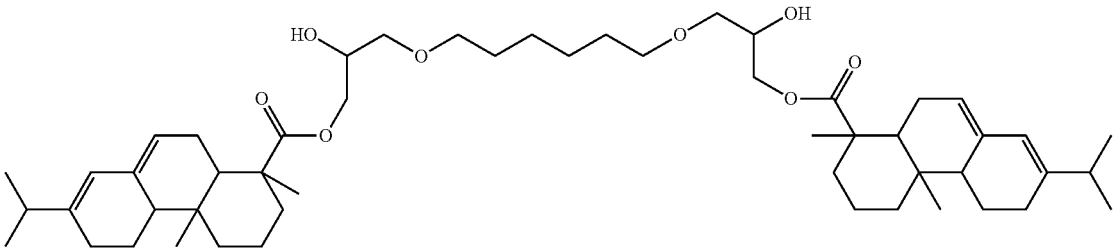
(13)
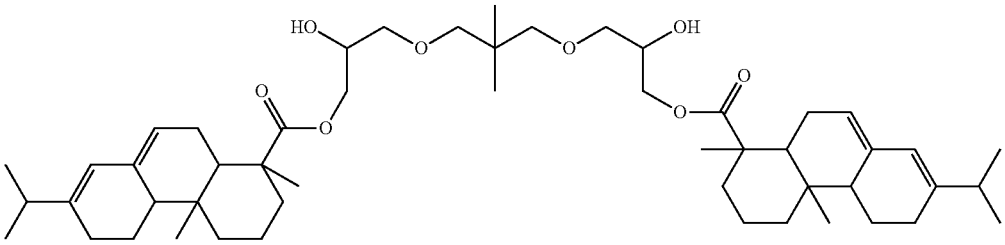
(14)
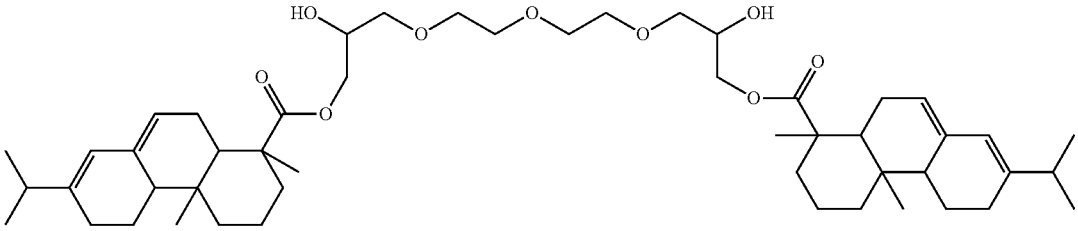

-continued
(15)
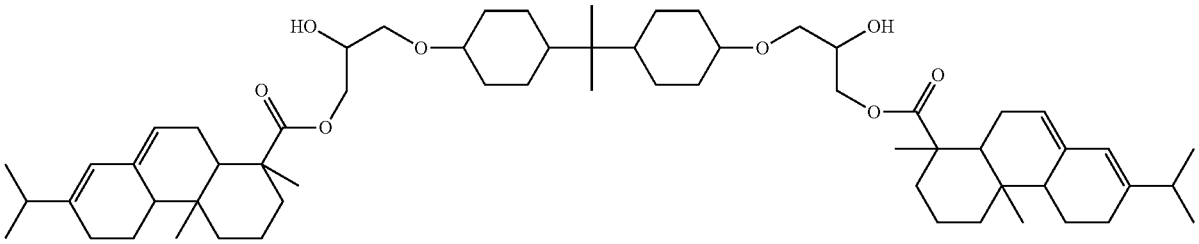
(16)
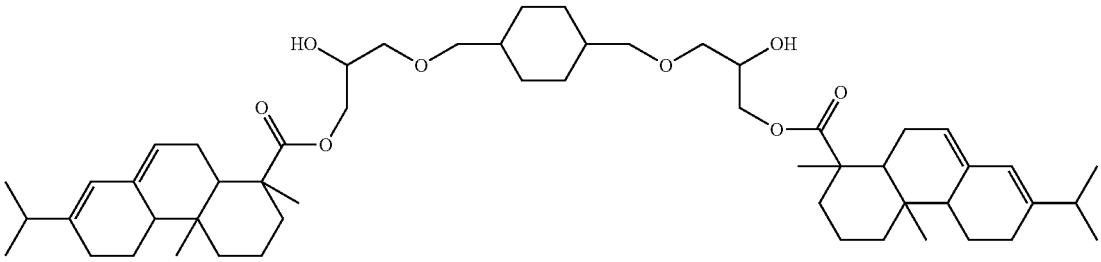
(17)
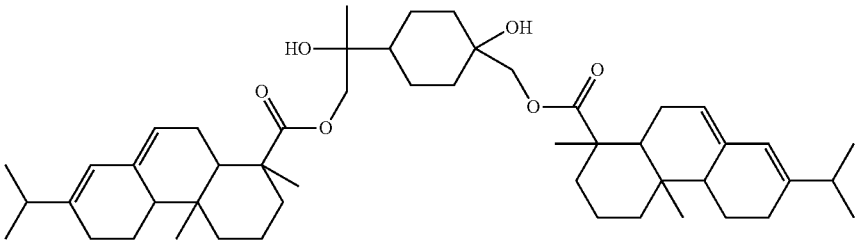
(18)
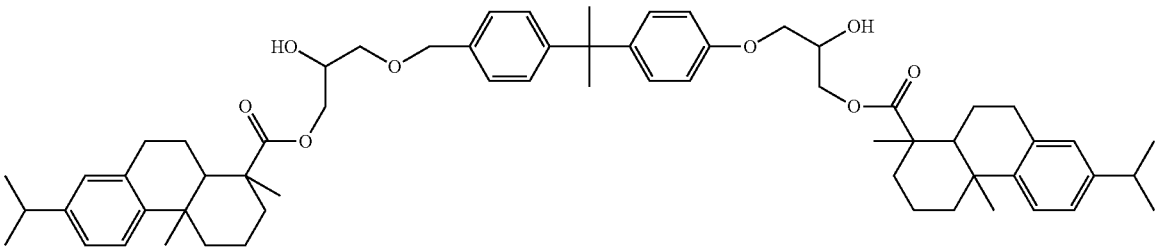
(19)
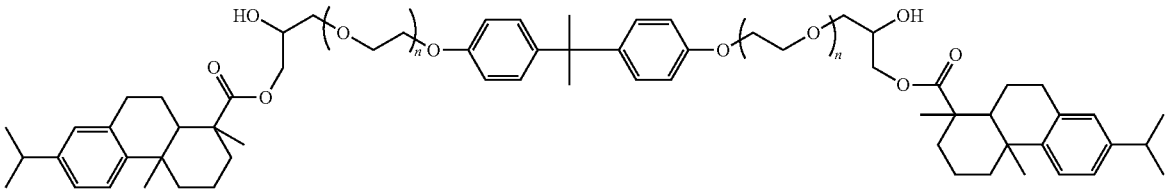
(20)
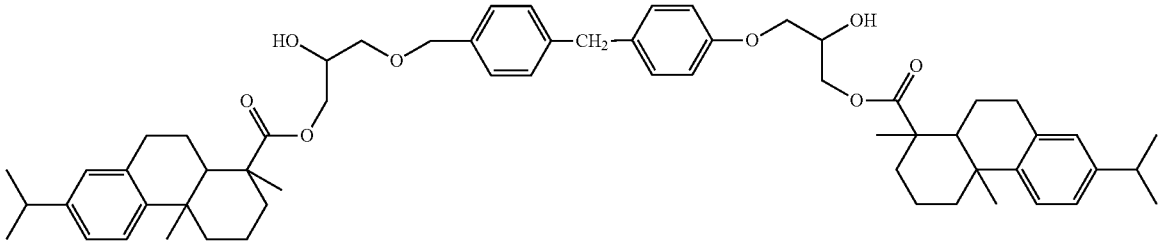

-continued
(21)
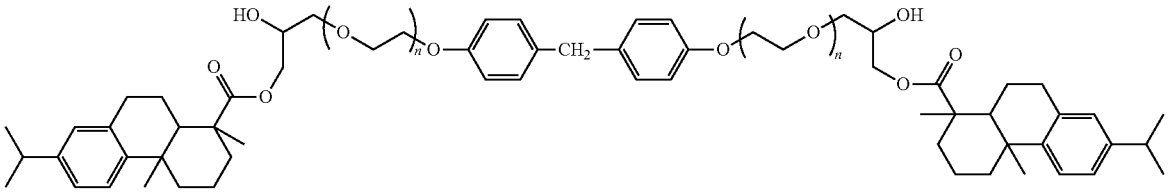
(22)
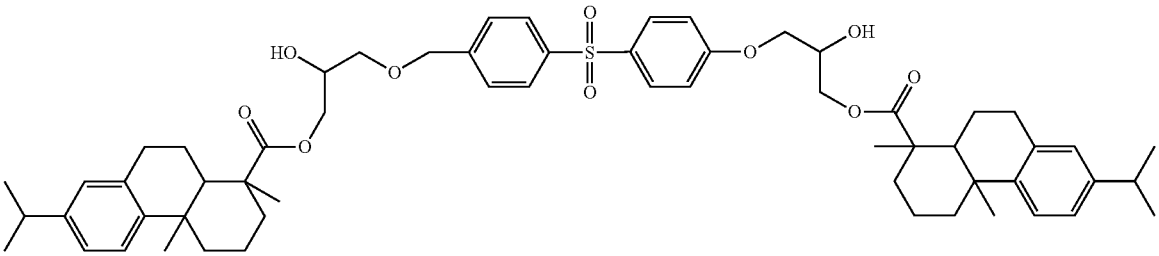
(23)
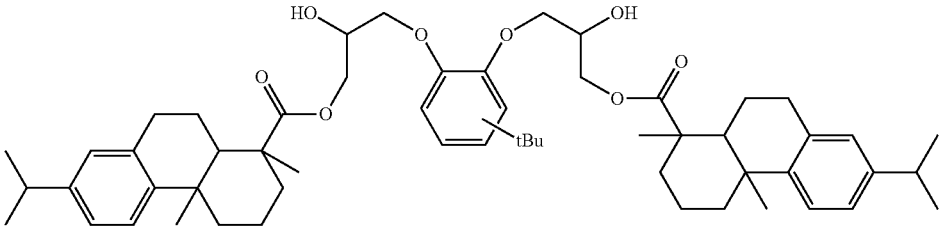
(24)
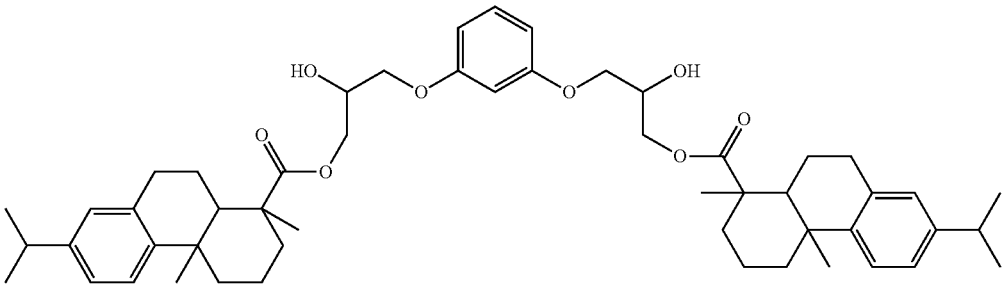
(25)
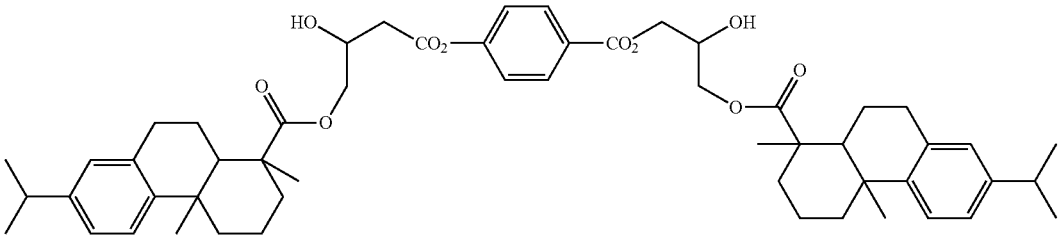
(26)
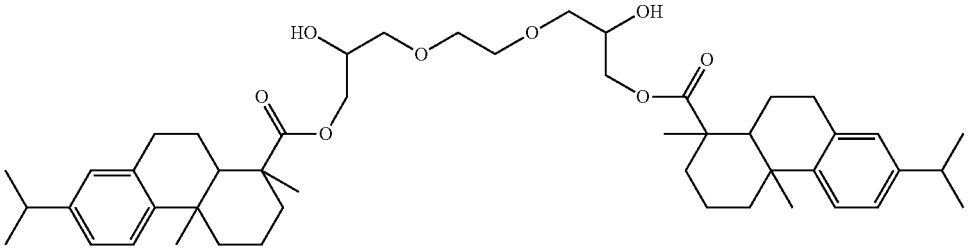

-continued
(27)
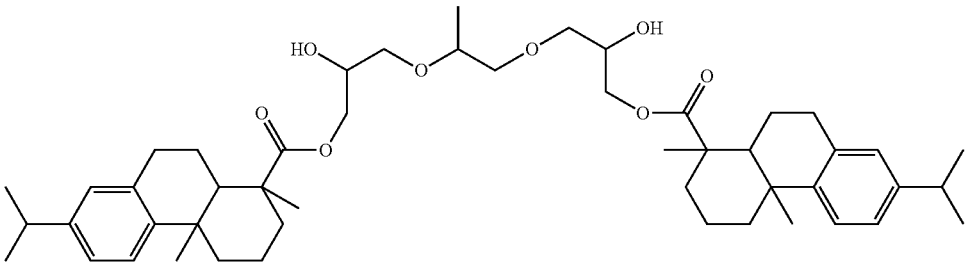
(28)
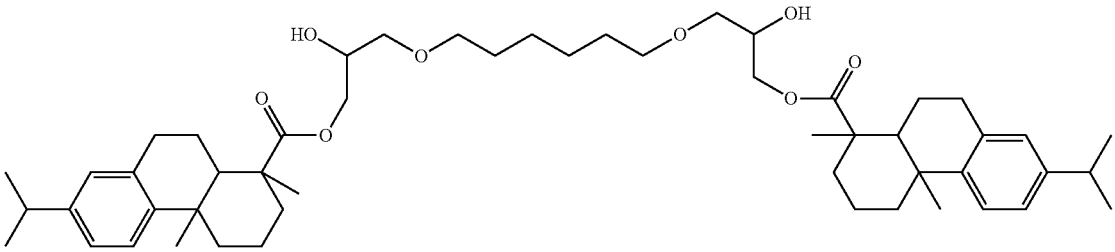
(29)
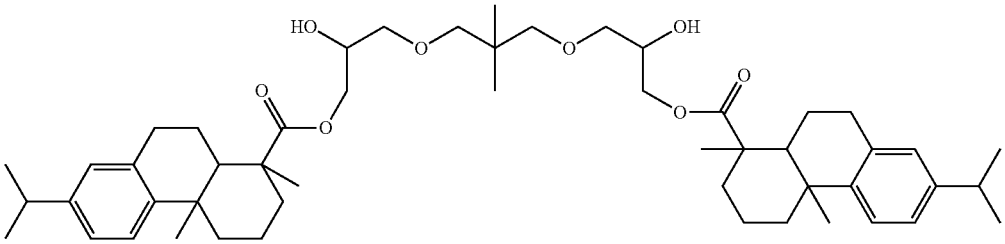
(30)
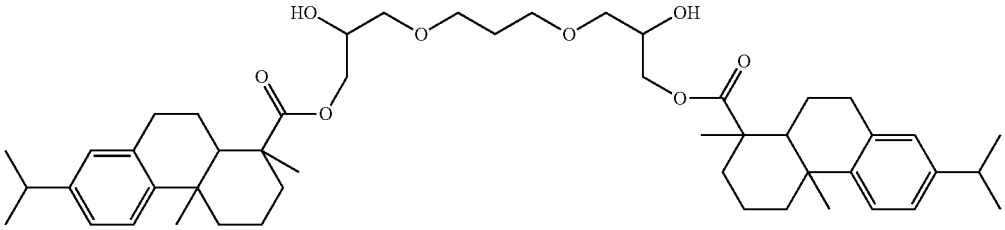
(31)
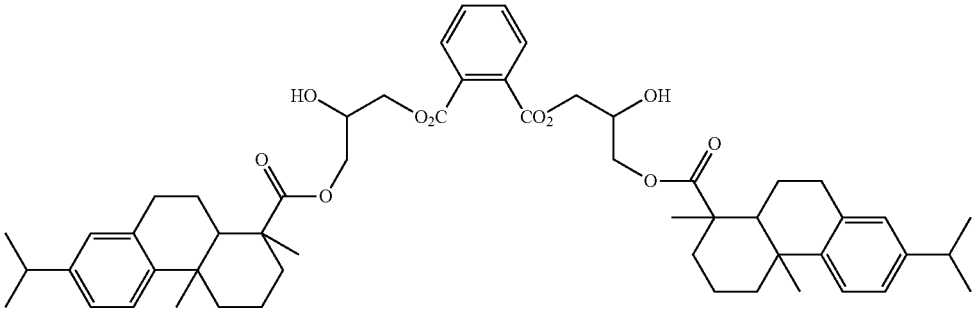
(32)
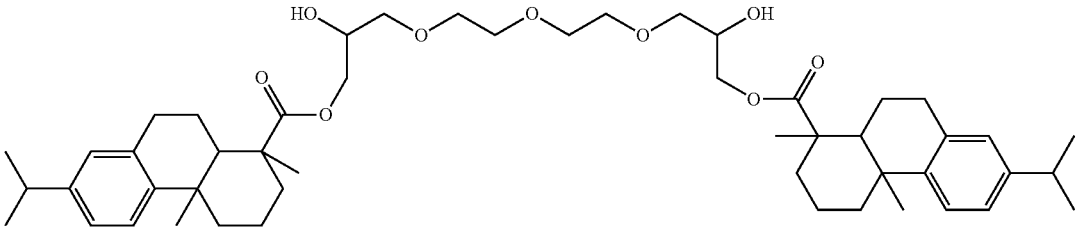

-continued
(33)
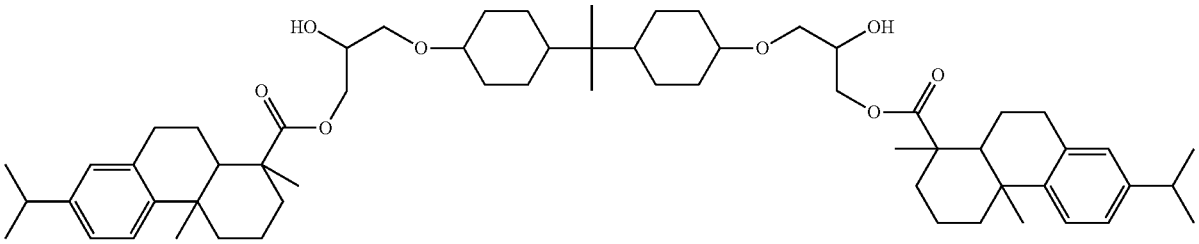
(34)
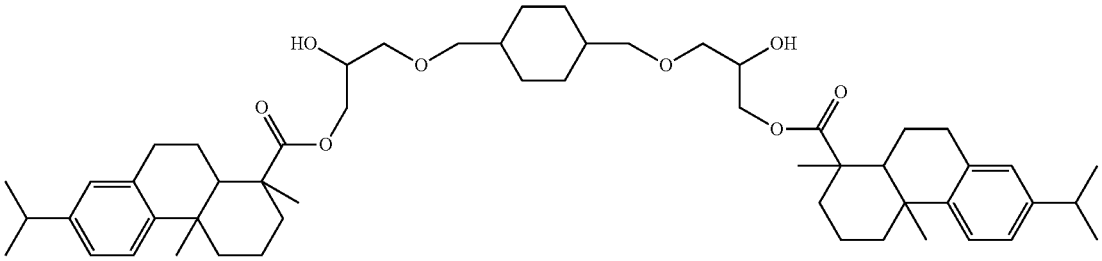
(35)
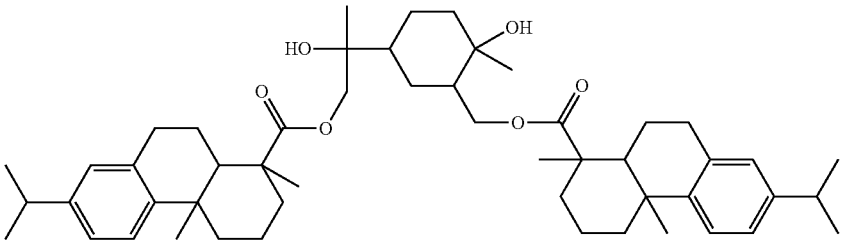
(36)
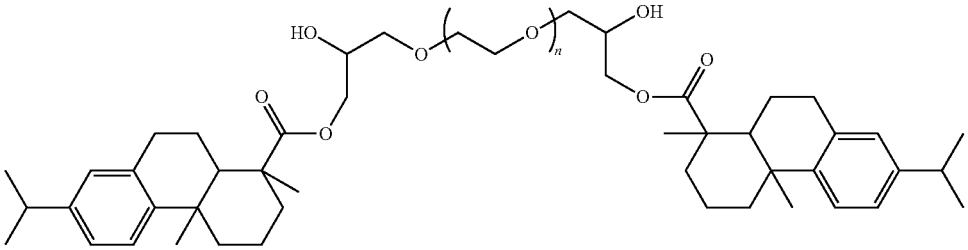
(37)
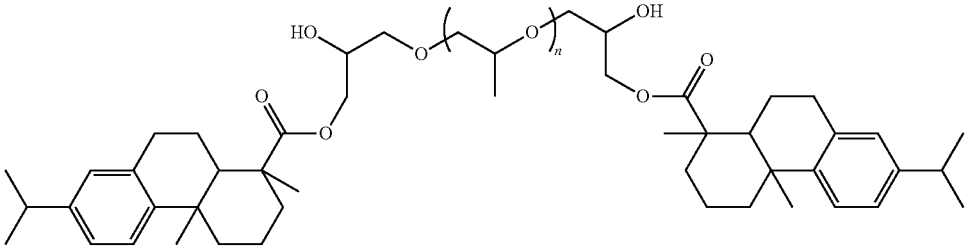
(38)
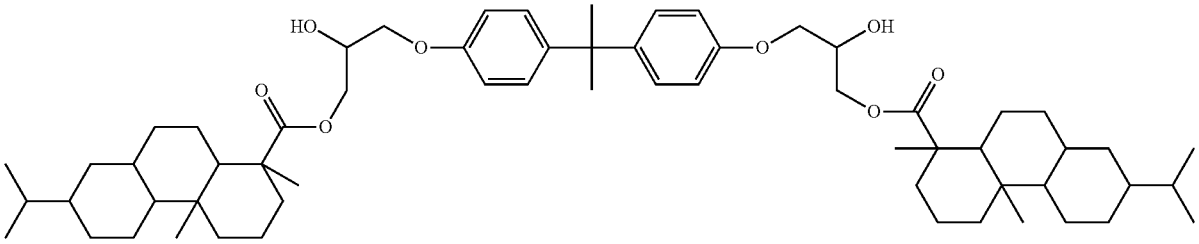

-continued (39)

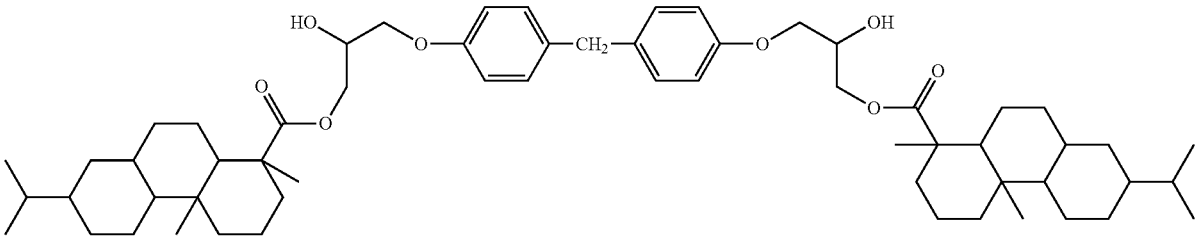

(40)

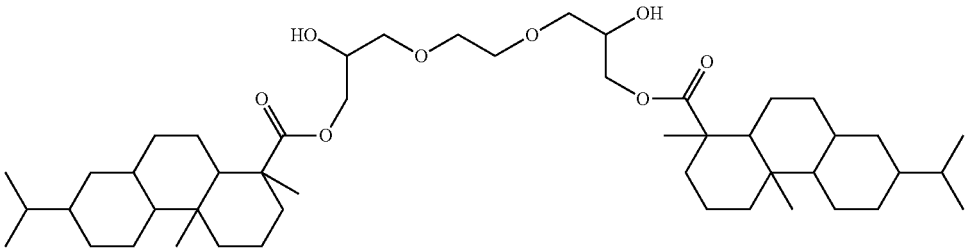

(41)

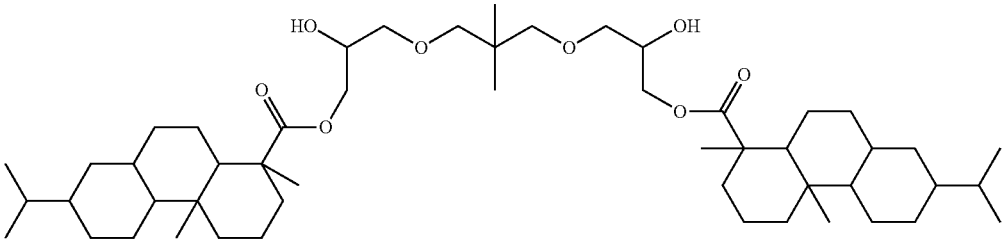

(42)

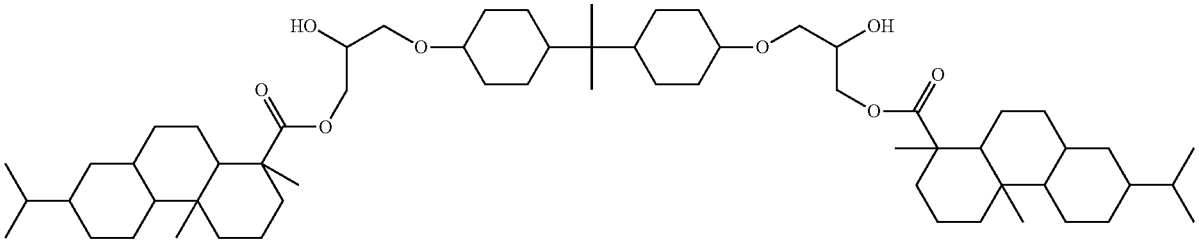

In the exemplary compounds of the rosin diol, n is an integer of 1 or more.

In this exemplary embodiment, an alcohol other than the rosin diol represented by general formula (1) may be used as an alcohol component in combination with the rosin diol. The proportion of the rosin diol represented by general formula (1) in all alcohol components is preferably 10 mol % or more and 100 mol % or less, and more preferably 20 mol % or more and 90 mol % or less from the viewpoints of the heat-resistant storage property and low-temperature fixability of toner.

At least one selected from the group consisting of aliphatic diols and aromatic diols may be used as an alcohol other than a rosin diol as long as the toner performance is not impaired.

Specific examples of the aliphatic diols include, but not limited to, ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glycol, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, dimerdiols, 3-hydroxy-2,2-dimethylpropyl-3-hydroxy-2,2-dimethylpropanoate, diethylene glycol, triethylene glycol, polyethylene glycol, dipropylene glycol, and polypropylene glycol.

Examples of the aromatic diols include, but not limited to, bisphenol A-ethylene oxide adduct, bisphenol A-propylene oxide adduct, and bisphenol A-ethylene oxide adduct.

These aliphatic diols and aromatic diols may be used alone or in combination.

Difunctional Epoxy Compound

In this exemplary embodiment, a difunctional epoxy compound is used as a crosslinking agent in polymerization.

The polyester for a toner according to this exemplary embodiment may be formed by reacting a rosin compound with an excessive amount of difunctional epoxy compound to prepare a mixture of a rosin diol represented by general formula (1) and the remaining difunctional epoxy compound, and subsequently polymerizing the mixture and a dicarboxylic acid.

Examples of the difunctional epoxy compound, which has two epoxy groups per molecule, include those listed above in the description of the rosin diol, namely, diglycidyl ethers of aromatic diols, diglycidyl ethers of aromatic dicarboxylic acids, diglycidyl ethers of aliphatic diols, diglycidyl ethers of alicyclic diols, and alicyclic epoxides.

In this exemplary embodiment, the proportion of difunctional epoxy compound in a condensation product of a dicarboxylic acid and a diol is preferably 1 mol % or more and 4 mol % or less and more preferably 2 mol % or more and 3 mol % or less.

Dicarboxylic Acid

Examples of the dicarboxylic acid component include dicarboxylic acids containing at least one selected from the group consisting of aromatic dicarboxylic acids and aliphatic dicarboxylic acids. Specific examples thereof include aromatic dicarboxylic acids such as phthalic acid, isophthalic acid, terephthalic acid, 1,4-naphthalenedicarboxylic acid, and 2,6-naphthalenedicarboxylic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, dimer acids, branched-chain alkylsuccinic acids having a carbon number of 1 or more and 20 or less, and branched-chain alkenylsuccinic acid having an alkenyl group and a carbon number of 1 or more and 20 or less; anhydrides of these acids; and alkyl (carbon number: 1 or more and 3 or less) esters of these acids.

Among these dicarboxylic acids, aromatic carboxylic acids are preferable from the viewpoints of the durability and fixability of toner and the dispersibility of colorant.

Among the above-described dicarboxylic acid components, preferred are dicarboxylic acid components containing at least one unsaturated dicarboxylic acid.

When the dicarboxylic acid component contains at least one unsaturated dicarboxylic acid, the polyester for a toner according to this exemplary embodiment is likely to be formed so as to have a weight-average molecular weight (Mw) of 40,000 or more and 150,000 or less and a molecular-weight distribution (Mw/Mn) of 12 or more and 25 or less or about 12 or more and about 25 or less.

This is presumably because the synthesized polyester for a toner tends to have a three-dimensionally crosslinked structure due to the propagation of radical polymerization starting from the unsaturated group of an unsaturated dicarboxylic acid in parallel with the polycondensation.

The term "unsaturated dicarboxylic acid" herein refers to a dicarboxylic acid having at least one unsaturated group per molecule. This dicarboxylic acid may be an anhydride of a dicarboxylic acid.

Specific examples thereof include fumaric acid, maleic acid, maleic anhydride, itaconic acid, citraconic acid, mesaconic acid, glutaconic acid, and traumatic acid. Preferred are fumaric acid, maleic acid, maleic anhydride, and itaconic acid. More preferred are fumaric acid, maleic acid, and maleic anhydride.

When fumaric acid, maleic acid, maleic anhydride, or itaconic acid is used as the unsaturated dicarboxylic acid, the heat-resistant storage property and low-temperature fixability of toner may be easily attained presumably because these acids are likely to increase the glass transition temperature of the resulting polyester more than other unsaturated dicarboxylic acids.

It is preferable to use unsaturated dicarboxylic acids and dicarboxylic acids other than unsaturated dicarboxylic acids in combination as the dicarboxylic acid components from the viewpoint of production stability.

The proportion of the unsaturated dicarboxylic acid in all dicarboxylic acid components is preferably 5 mol % or more and 80 mol % or less, more preferably 10 mol % or more and 70 mol % or less, and further preferably 25 mol % or more and 60 mol % or less.

Preparation of Polyester for Toner

The polyester for a toner according to this exemplary embodiment is prepared by a publicly known production method from the following raw materials: a dicarboxylic acid, rosin diol represented by general formula (1), and a difunctional epoxy compound. The difunctional epoxy compound may have been added as a result of adding an excessive amount of difunctional epoxy compound at the synthesis of the rosin diol represented by general formula (1).

Either transesterification or direct esterification may be employed as a reaction method. The polycondensation may be promoted by applying pressure to increase the reaction temperature, by reducing pressure, or by injecting an inert gas under an atmospheric pressure. Optionally, depending on the reaction method employed, a known reaction catalyst including at least one metal compound selected from antimony compounds, titanium compounds, tin compounds, zinc compounds, aluminium compounds, and manganese compounds may be used to promote the reaction. The amount of the reaction catalyst added is preferably 0.01 parts by mass or more and 1.5 parts by mass or less and more preferably 0.05 parts by mass or more and 1.0 parts by mass or less relative to 100 parts by mass of total of the acid components and alcohol components. The reaction temperature is preferably 180° C. or more and 300° C. or less.

An example of the scheme for reacting the rosin diol represented by general formula (1) and a dicarboxylic acid component is shown below.

In the structural formula representing a polyester, the portion outlined in a dotted line corresponds to the rosin ester group according to this exemplary embodiment.

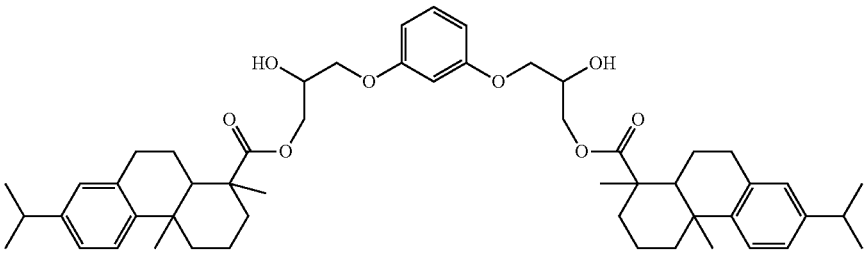

ROSIN DIOL

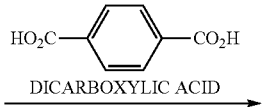

-continued

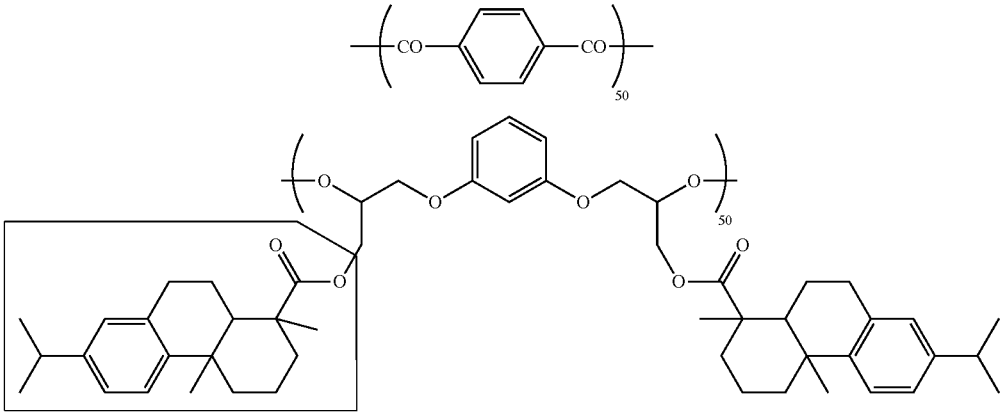

POLYESTER RESIN

The polyester for a toner according to this exemplary embodiment is decomposed into the following monomers by hydrolysis. The components of the resin are determined on the basis of the decomposed products since the polyester is a 1:1 condensation product of a dicarboxylic acid and a diol.

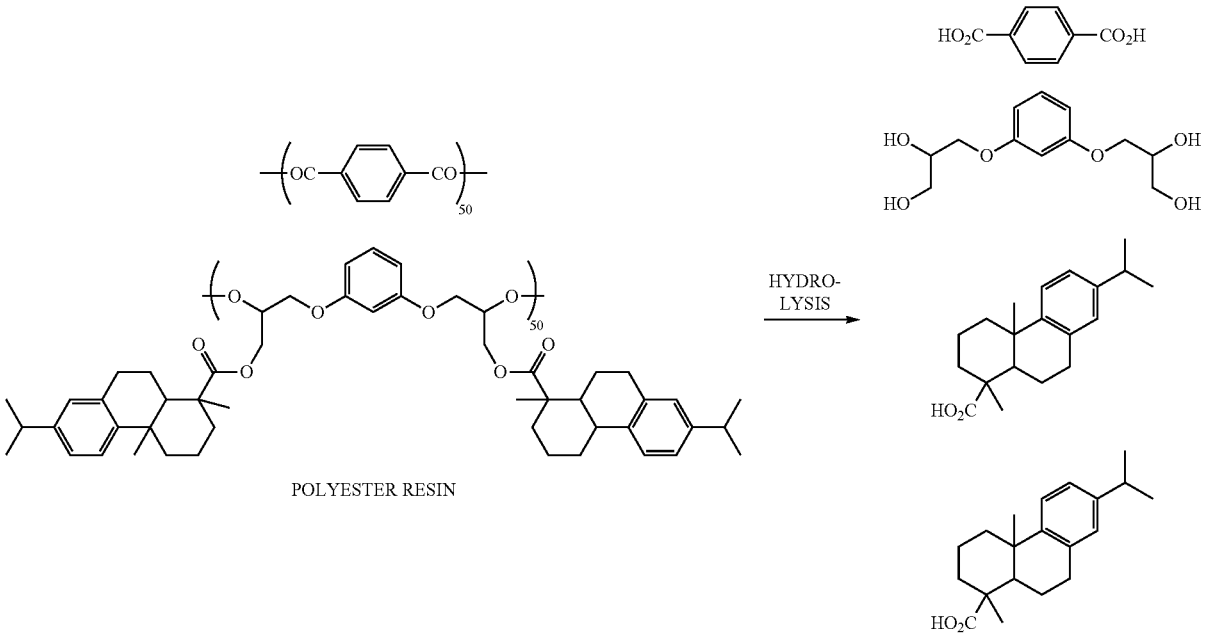

POLYESTER RESIN

Characteristics of Polyester for Toner

The polyester for a toner according to this exemplary embodiment preferably has a weight-average molecular weight (Mw) of 40,000 or more and 150,000 or less, more preferably 45,000 or more and 100,000 or less, and further preferably 50,000 or more and 90,000 or less.

The weight-average molecular weight is preferably 40,000 or more from the viewpoint of the heat-resistant storage property of toner.

The weight-average molecular weight is preferably 150,000 or less from the viewpoint of the low-temperature fixability of toner.

The number-average molecular weight (Mn) is preferably 2,000 or more and 7,000 or less, more preferably 3,000 or more and 6,500 or less, and further preferably 3,500 or more and 6,000 or less from the above-mentioned viewpoints.

The softening temperature is preferably 80° C. or more and 160° C. or less, and more preferably 90° C. or more and 150° C. or less from the viewpoints of the fixability, storage property, and durability of toner.

The softening temperature is determined as a temperature (FT 1/2 stroke temperature) corresponding to a midpoint between a flow-beginning point and a flow-end point observed when a 1 $cm^3$ sample is melted and flows at a test pressure of 0.98 MPa (10 $kg/cm^2$) and a heating rate of 1°

C./min using a Flowtester CFT-500 (produced by Shimadzu Corporation) with a die having an orifice diameter of 0.5 mm.

The glass transition temperature is preferably 35° C. or more and 80° C. or less and more preferably 40° C. or more and 70° C. or less from the viewpoints of fixability, storage property, and durability.

The glass transition temperature of 55° C. or more may impart good heat-resistant storage property to the polyester for a toner.

The glass transition temperature is measured using "DSC-20" (produced by Seiko Instruments Inc.) by heating a sample (10 mg) at a constant heating rate (10° C./min).

The softening temperature and glass transition temperature may be easily controlled by changing raw material monomer formation, the amount of polymerization initiator, the molecular weight, the amount of catalyst, or the like, or selecting the reaction conditions.

The acid value is preferably 1 mg KOH/g or more and 50 mg KOH/g or less and more preferably 3 mg KOH/g or more and 30 mg KOH/g or less from the viewpoint of the charging characteristics of electrostatic-image developing toner.

The acid value is determined by neutralization titration in accordance with JIS K0070 in the following manner. An adequate amount of aliquot is taken from the sample. Few drops of a solvent (100 ml, liquid mixture of diethyl ether and ethanol) and an indicator (phenolphthalein solution) are added to the sample aliquot. The mixture is shaken thoroughly on a water bath until the sample aliquot is dissolved in the solvent. The resulting solution is titrated with 0.1 mol/l solution of potassium hydroxide in ethanol. The end point is determined as a point at which an indicator shows light pink for 30 seconds. Then, acid value A is calculated by the following expression:

$$A-(B\times f\times 5.611)/S$$

where S (g) is the amount of sample, B (ml) is the amount of 0.1 mol/l solution of potassium hydroxide in ethanol used in the titration, and f is a factor of 0.1 mol/l solution of potassium hydroxide in ethanol.

The polyester for a toner according to this exemplary embodiment may be a modified polyester. Examples of the modified polyester include polyesters modified with phenol, urethane, epoxy, or the like to form a graft or block polyester in the manner described in, for example, Japanese Unexamined Patent Application Publication 11-133668, Japanese Unexamined Patent Application Publication 10-239903, and Japanese Unexamined Patent Application Publication 8-20636.

Electrostatic-Image Developing Toner

The electrostatic-image developing toner according to an exemplary embodiment includes the polyester for a toner according to an exemplary embodiment.

The toner according to this exemplary embodiment will now be described in detail.

The toner according to this exemplary embodiment includes, for example, toner particles and, optionally, an external additive.

Toner Particles

The toner particles are described below.

The toner particles each include a binder resin, optionally, a colorant, a mold release agent, and other additives.

Binder Resin

An example of the binder resin is an amorphous resin, as which the polyester for a toner according to an exemplary embodiment is used.

A crystalline resin may be used as a binder resin in combination with an amorphous resin.

Amorphous resins other than the polyester for a toner according to an exemplary embodiment may be also used as the binder resins in combination with the polyester for a toner according to an exemplary embodiment.

The content of the polyester for a toner according to an exemplary embodiment is preferably 70 parts by mass or more, and more preferably 90 parts by mass or more relative to the 100 parts by mass of all binder resins.

The term "amorphous resin" herein refers to a resin that, in thermal analysis using differential scanning calorimetry (DSC), exhibits step-like endothermic change instead of a distinct endothermic peak, that is in a solid state at room temperature (e.g., 25° C.), and that is plasticized by heat at a temperature equal to or more than the glass transition temperature.

In contrast, the term "crystalline resin" herein refers to a resin that, in thermal analysis using differential scanning calorimetry (DSC), exhibits a distinct endothermic peak instead of step-like endothermic change.

Specifically, for example, the crystalline resin refers to a resin that exhibits an endothermic peak with a half-width of 10° C. or less at a heating rate 10° C./min and the amorphous resin refers to a resin that exhibits an endothermic peak with a half-width exceeding 10° C. or exhibits no distinct endothermic peak.

Examples of the crystalline resin include crystalline polyesters, polyalkylene resins, and long-chain alkyl(meth)acrylate resins. Preferred crystalline resins are crystalline polyesters, which allow the viscosity of the resulting toner to increase quickly due to heating and allow the resulting toner to achieve both good mechanical strength and low-temperature fixability.

Preferred examples of the crystalline polyesters include polycondensates of aliphatic dicarboxylic acids (including their acid anhydrides and their acid chlorides) and aliphatic diols from the viewpoint of low-temperature fixability.

The content of the crystalline resin is preferably 1 part by mass or more and 20 parts by mass or less and more preferably 5 parts by mass or more and 15 parts by mass or less relative to 100 parts by mass of all binder resins.

Low-temperature fixing herein refers to fixing a toner by heating the toner at about 120° C. or less.

Examples of the amorphous resins other than the polyester for a toner according to an exemplary embodiment include other known binder resins such as vinyl resins (e.g., styrene-acrylic resin), epoxy resins, polycarbonates, and polyurethanes.

Colorant

The colorant may be, for example, either a dye or a pigment, but is preferably a pigment from the viewpoints of lightfastness and water resistance.

Examples of the colorant include known pigments such as carbon black, aniline black, aniline blue, calco oil blue, chrome yellow, ultramarine blue, dupont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

Optionally, the colorant may be surface-treated or used in combination with a pigment dispersant.

A yellow toner, magenta toner, cyan toner, black toner, etc may be produced by selecting the type of colorant.

The content of the colorant is preferably 1 part by mass or more and 30 parts by mass or less relative to 100 parts by mass of the binder resin.

Mold Release Agent

Examples of the mold release agent include paraffin waxes composed of low-molecular-weight polypropylene, low-molecular-weight polyethylene, or the like; silicone resins; rosins; rice waxes; and carnauba wax. These mold release agents preferably have a melting temperature of 50° C. or more and 100° C. or less, and more preferably have a melting temperature of 60° C. or more and 95° C. or less.

The content of the mold release agent is preferably 0.5 parts by mass or more and 15 parts by mass or less, and more preferably 1.0 parts by mass or more and 12 parts by mass or less relative to 100 parts by mass of the binder resin.

When the proportion of the mold release agent is 0.5% by mass or more, the occurrence of poor release, particularly in oil-less fusing, may be reduced. When the proportion of the mold release agent is 15% by mass or less, a toner with high reliability in terms of image quality and image forming may be produced without impairing the fluidity of the toner.

Other Additives

Any known charge-controlling agents may be used. Examples thereof include azo metal complexes, metal salicylate complexes, and resins having a polar group.

Characteristics of Toner Particles

The toner particles may be either single-layered toner particles or "core-shell" toner particles, which are each composed of a core (core particle) and a coating layer (shell layer) covering the core.

The core-shell toner particles may each include, for example, a core composed of a binder resin (polyester or crystalline polyester according to an exemplary embodiment) and, optionally, other additives such as a colorant and a mold release agent; and a coating layer composed of a binder resin (polyester according to an exemplary embodiment).

The volumetric average particle diameter of the toner particles is, for example, preferably 2.0 μm or more and 10 μm or less and more preferably 3.5 μm or more and 7.0 μm or less.

The volumetric average particle diameter of the toner particles is determined in the following manner. A test sample (0.5 mg or more and 50 mg or less) is added to 2 ml of a surfactant, preferably, 5% by mass sodium alkylbenzene sulfonate aqueous solution, serving as a dispersant. The mixture is then added to 100 ml or more and 150 ml or less of an electrolyte. The electrolyte, in which the test sample is suspended, is dispersed for 1 minute using an ultrasonic wave disperser. Then, the particle size distribution of the particles having a diameter of 2.0 μm or more and 60 μm or less is determined using Coulter Multisizer II (produced by Beckman Coulter, Inc.) with an aperture having a diameter of 100 μm. The number of the particles measured is 50,000.

The volumetric-average particle size D50v is determined as follows. The particle size distribution is divided into a number of particle size ranges (channels). For each range, in ascending order in terms of particle size, the cumulative volume is calculated and plotted to draw a cumulative volume distribution. The volumetric-average particle size D50v is defined as a particle size at which the cumulative particle volume reaches 50% in the cumulative volume distribution.

The shape factor SF1 of the toner particles is, for example, preferably 110 or more and 150 or less and more preferably 120 or more and 140 or less.

The shape factor SF1 is calculated by expression (1):

$$SF1=(ML^2/A)\times(\pi/4)\times 100 \quad (1)$$

where ML is the absolute maximum length of a toner particle and A is the projected area of a toner particle.

Generally, SF1 is calculated by analyzing a microscope image or a scanning electron microscope (SEM) image with an image processor in the following manner. An optical microscopic image of particles distributed in the surface of a slide glass is incorporated into a LUZEX image processor through a video camera. For each of one-hundred particles, maximum length and projected area of the particle are measured and SF1 is calculated by expression (1). SF1 are then averaged over the one-hundred particles to obtain SF1 of the toner particles.

External Additive

An example of the external additive is inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles serving as external additives may be hydrophobized in advance, for example, by immersing the inorganic particles in a hydrophobizing agent. The hydrophobizing agent is not particularly limited, and examples thereof include silane coupling agents, silicone oils, titanate coupling agents, and aluminate coupling agents. These hydrophobizing agent may be used alone or in combination.

The amount of hydrophobizing agent is generally, for example, about 1 part by mass or more and about 10 parts by mass relative to 100 parts by mass of inorganic particles.

Examples of the external additive include resin particles (e.g., polystyrene resin particles, polymethyl methacrylate resin (PMMA) particles, and melamine resin particles), and cleaning activators (e.g. metal salts of higher fatty acids, such as zinc stearate, and the particles of fluoropolymers).

The amount of the external additive added is preferably, for example, 0.01 parts by mass or more and 5 parts by mass or less, and more preferably 0.01 parts by mass or more and 2.0 parts by mass or less relative to 100 parts by mass of toner particles.

Toner Preparation Method

The method for producing a toner according to an exemplary embodiment will now be described.

The toner particles may be produced either by a dry manufacturing method (e.g., kneading pulverization) or by a wet manufacturing method (e.g., aggregation coalescence, suspension polymerization, dissolution suspension granulation, dissolution suspension, or dissolution emulsification aggregation coalescence). These production methods are not particularly limited and any known method may be employed.

A method for producing toner particles by aggregation coalescence method will be described below.

The specific method is as follows.

A method for preparing toner particles each containing a colorant and a mold release agent is now explained. However, the colorant and mold release agent are optional. Needless to say, other additives may be also optionally used in addition to the colorant and mold release agent.

Resin Particle Dispersion Preparation Step

A resin particle dispersion in which polyester particles (particles of the polyester for a toner according to an exemplary embodiment) are dispersed is prepared. In addition, for example, a colorant particle dispersion in which colorant particles are dispersed and a mold release agent dispersion in which mold release agent particles are dispersed are prepared.

The resin particle dispersion are prepared, for example, by dispersing the polyester particles in a disperse medium using a surfactant.

An example of the disperse medium used to prepare the resin particle dispersion is an aqueous medium.

Examples of the aqueous medium include waters such as distilled water and ion exchange water and alcohols. These aqueous media may be used alone or in combination.

The surfactant is not particularly limited and example thereof include anionic surfactants such as sulfate esters, sulfonates, phosphate esters, and soaps; cationic surfactants such as amines and quaternary ammonium salts; and nonionic surfactants such as polyethylene glycols, alkylphenol ethylene oxide adducts, and polyhydric alcohols. Among these surfactants, the anionic surfactants and the cationic surfactants are preferable. The nonionic surfactants may be used in combination with the anionic surfactants or the cationic surfactants.

The surfactants may be used alone or in combination.

Examples of a method for dispersing the polyester particles in the disperse medium in preparing the resin particle dispersion include common dispersion methods by using, for example, a rotary-sharing homogenizer, a ball mill with grinding media, a sand mill, or Dyno Mill. Depending on the type of resin particles, alternatively, the resin particles may be dispersed in the resin particle dispersion by, for example, phase-inversion emulsification.

The phase-inversion emulsification is a method including dissolving a resin to be dispersed in a hydrophobic organic solvent in which the resin can be dissolved, adding a base to an organic continuous phase (O phase) to neutralize the solution, and subsequently adding an aqueous medium (W phase) to the solution so that the resin is converted from W/O phase to O/W phase (phase inversion) to exhibit a discontinuous phase, thus dispersing the resin in the aqueous medium in the form of particles.

The volumetric average particle diameter of the polyester particles dispersed in the resin particle dispersion is, for example, 0.01 μm or more and 1 μm or less and may be 0.08 μm or more and 0.8 μm or less, or 0.1 μm or more and 0.6 μm.

The volumetric average particle diameter of the resin particles is determined using a laser diffraction particle size distribution measuring equipment (LA-920 produced by HORIBA, Ltd.). Herein, the volumetric average particle diameter is determined using this equipment unless otherwise indicated.

The proportion of the polyester particles in the resin particle dispersion is, for example, 5% by mass or more and 50% by mass or less and may be 10% by mass or more and 40% by mass or less.

The colorant dispersion, the mold release agent dispersion, and the like may be also prepared as in the dispersion of the resin particles. In other words, the volumetric average particle diameter, the disperse medium, the dispersion method, and the content of the particle of the colorant particles dispersed in the colorant dispersion or mold release agent particles dispersed in the mold release agent dispersion are same as those in the dispersion of the resin particles.

Aggregated Particle Forming Step

The resin particle dispersion is mixed with the colorant particle dispersion and the mold release agent dispersion.

In the dispersion mixture, the polyester particles, the colorant particles, and the mold release agent particles are hetero-aggregated to form aggregated particles including the polyester particles, the colorant particles, and the mold release agent particles, the aggregated particles having a diameter nearly equal to the desired diameter of the toner particles.

Specifically, for example, the aggregated particles are formed by adding an aggregating agent to the dispersion mixture, adjusting the pH of the dispersion mixture to be acidic (e.g., 2 or more and 5 or less), optionally adding a dispersion stabilizer, subsequently heating the dispersion mixture to a temperature lower than the glass transition temperature of the polyester particles (specifically, e.g., a temperature lower than the glass transition temperature by 10° C. to 30° C.), and aggregating the particles dispersed in the dispersion mixture.

In this aggregated particle forming step, alternatively, the aggregating agent may be added to the dispersion mixture under stirring with a rotary-sharing homogenizer at room temperature (e.g., 25° C.), followed by adjusting the pH of the dispersion mixture to be acidic (e.g., 2 or more and 5 or less), optionally adding a dispersion stabilizer, subsequently heating the dispersion mixture in the above-described manner.

Examples of the aggregating agent include surfactants having a polarity opposite to that of the surfactant used as a dispersant added to the dispersion mixture, for example, inorganic metal salts and multivalent metal complexes. In particular, the use of a metal complex as an aggregating agent reduces the amount of the surfactant used and improves the charging characteristics of toner.

Optionally, an additive that forms a complex or a bond similar to the complex with the metal ion serving as the aggregating agent may be used. Chelating agents may be used for such additives.

Examples of the inorganic metal salts include metal salts such as calcium chloride, calcium nitrate, barium chloride, magnesium chloride, zinc chloride, aluminium chloride, and aluminium sulfate; and inorganic metal salt polymers such as aluminium polychloride, aluminium polyhydroxide, and calcium polysulfide.

The chelating agent may be a water-soluble chelating agent. Examples of the chelating agent include oxycarboxylic acids such as tartaric acid, citric acid, and gluconic acid; imino diacid (IDA); nitrilo triacetic acid (NTA); and ethylenediaminetetraacetic acid (EDTA).

The amount of the chelating agent added is, for example, 0.01 parts by mass or more and 5.0 parts by mass or less and may be 0.1 parts by mass or more and less than 3.0 parts by mass relative to 100 parts by mass of the polyester particles.

Fusion and Coalescence Step

The aggregated particle dispersion in which the aggregated particles are dispersed is, for example, heated to a temperature higher than the glass transition temperature of the polyester particles (e.g., a temperature higher than the glass transition temperature by 10° C. to 30° C.) to fuse and coalesce the aggregated particles, forming toner particles.

The toner particles are produced through the above described steps.

Alternatively, the toner particles may be produced by, after preparing an aggregated particles dispersion in which aggregated particles are dispersed, further mixing the aggregated particles dispersion with a resin particle dispersion, in which polyester particles (polyester particles according to an exemplary embodiment) are dispersed, to further aggregate the aggregated particles by attaching the polyester particles to the surfaces of the aggregated particles and subsequently by heating a second aggregated particles dispersion, in which second aggregated particles are dispersed, to fuse and coalescence the second aggregated particles, thereby forming core-shell structure toner particles.

After the fusion and coalescence step, the toner particles formed in the solution are subjected to a known cleaning step, a solid-liquid separation step, and a drying step, to prepare dry toner particles.

In the cleaning step, the toner particles may be subjected to displacement washing thoroughly using ion exchange water from the viewpoint of charging characteristics. In the solid-liquid separation step, although there are no particular limitations on the method therefor, suction filtration, pressure filtration, and the like may be employed from the viewpoint of productivity. Although there are no particular limitations on the method for the drying step, freeze-drying, flash-jet drying, fluid-bed drying, vibrating fluid-bed drying, and the like may be employed from the viewpoint of productivity.

The toner according to this exemplary embodiment may be formed, for example, by adding an external additive to the resulting dry toner particles and mixing them together. The mixing may be carried out using, for example, V-blender, Henschel mixer, or Loedige mixer. Optionally, a vibration sieving machine, an air-flow sieving machine, and the like may be used in order to remove coarse particles in the toner.

Electrostatic-Image Developer

The electrostatic-image developer according to an exemplary embodiment includes the toner according to an exemplary embodiment.

The electrostatic-image developer according to this exemplary embodiment may be a monocomponent developer containing only the toner according to an exemplary embodiment or may be a two-component developer composed of a mixture of the toner according to an exemplary embodiment and a carrier.

The carrier is not particularly limited and may be a known carrier. Examples of the carrier include a resin coated carrier, a magnetic-particle dispersed carrier, and a resin dispersed carrier.

In the two-component developer, the mixing ratio (mass ratio) of the toner according to an exemplary embodiment to the carrier is preferably about 1:100 to about 30:100, and more preferably about 3:100 to about 20:100.

Image-Forming Apparatus and Image-Forming Method

The image-forming apparatus and image-forming method according to an exemplary embodiment will now be described.

The image-forming apparatus according to this exemplary embodiment includes an image-carrying member, a charging unit that charges the surface of the image-carrying member, an electrostatic-image-forming unit that forms an electrostatic image on the surface of the image-carrying member, a developing unit that includes the electrostatic-image developer and develops the electrostatic image using the electrostatic-image developer to form a toner image, a transfer unit that transfers the toner image to a recording medium, and a fixing unit that fixes the toner image to the recording medium.

The image-forming apparatus according to this exemplary embodiment employs the electrostatic-image developer according to an exemplary embodiment as the electrostatic-image developer.

In the image-forming apparatus according to an exemplary embodiment, for example, a part including the developing unit may be a cartridge (process cartridge) detachably attached to the image-forming apparatus. An example of a preferred process cartridge is a process cartridge that includes an electrostatic-image developer according to an exemplary embodiment and a developing unit.

The image-forming method according to this exemplary embodiment includes charging the surface of the image-carrying member, forming an electrostatic image on the surface of the charged image-carrying member, developing the electrostatic image using an electrostatic-image developer to form a toner image, transferring the toner image to a recording medium, and fixing the toner image to the recording medium.

The image-forming method according to this exemplary embodiment employs the electrostatic-image developer according to an exemplary embodiment as the electrostatic-image developer.

An example of the image-forming apparatus according to this exemplary embodiment will now be described, but the image-forming apparatus is not limited thereto. Only components shown in drawings are described; others are omitted.

FIG. 1 is a schematic diagram illustrating a four-drum-tandem color image-forming apparatus. The image-forming apparatus illustrated in FIG. 1 includes first to fourth electrophotographic image-forming units 10Y, 10M, 10C, and 10K that form yellow (Y), magenta (M), cyan (C), and black (K) images, respectively, based on color separation image data. The image-forming units (hereafter may be referred to simply as "units") 10Y, 10M, 100, and 10K are horizontally arranged in parallel at a predetermined distance from one another. The units 10Y, 10M, 100, and 10K may be process cartridges detachably attached to the image-forming apparatus.

An intermediate transfer belt 20 serving as an intermediate transfer body runs above and through the units 10Y, 10M, 100, and 10K in the drawing. The intermediate transfer belt 20 is wound around a drive roller 22 and a support roller 24, which are spaced apart from each other and brought into contact with the inner surface of the intermediate transfer belt 20. The intermediate transfer belt 20 runs clockwise in the drawing, i.e., from the first unit 10Y to the fourth unit 10K. The support roller 24 is subjected to a force by a spring or the like (not shown) in a direction away from the drive roller 22, thereby applying tension to the intermediate transfer belt 20 wound around the drive roller 22 and the support roller 24. An intermediate transfer body-cleaning device 30 is disposed so as to face the image-carrier side of the intermediate transfer belt 20 and to face the drive roller 22.

Developing devices (developing units) 4Y, 4M, 4C, and 4K of units 10Y, 10M, 100, and 10K are supplied with yellow, magenta, cyan, and black toners stored in toner cartridges 8Y, 8M, 8C, and 8K, respectively.

The following description is made with reference to the first unit 10Y that forms an yellow image and located upstream in the intermediate transfer belt-running direction, as a representative, since the first to fourth units 10Y, 10M, 10C, and 10K have the similar structure to one another. Members are each labeled with the same reference numeral as the reference numeral of the first unit 10Y except that magenta (M), cyan (C), or black (K) is used instead of yellow (Y) and the description of the second to fourth units 10M, 10C, and 10K are omitted.

The first unit 10Y includes a photoreceptor 1Y serving as an image-carrying member. The following are disposed around the photoreceptor 1Y sequentially in the counter-clockwise direction: a charging roller 2Y that charges the surface of the photoreceptor 1Y at a predetermined potential; an exposure device (electrostatic-image-forming unit) 3 that forms an electrostatic image by irradiating the charged surface of the photoreceptor 1Y with a laser beam 3Y based on a color separated image signal; a developing device (developing unit) 4Y that develops the electrostatic image by supplying a charged toner to the electrostatic image; a first transfer roller 5Y (first transfer unit) that transfers the developed toner image onto the intermediate transfer belt 20; and a photoreceptor-cleaning device (cleaning unit) 6Y that removes the remaining toner from the surface of the photoreceptor 1Y after the first transfer.

The first transfer roller 5Y is disposed on the inner surface of the intermediate transfer belt 20 so as to face the photoreceptor 1Y. The first transfer rollers 5Y, 5M, 5C, and 5K are each connected with a bias supply (not shown) that applies a first transfer bias to the first transfer rollers. Each bias supply varies the transfer bias applied to the corresponding first transfer roller on the basis of the control by a controller (not shown).

The action of forming a yellow image in the first unit 10Y is now described. Prior to the action, the surface of the photoreceptor 1Y is charged at a potential of about −600 to about −800 V by the charging roller 2Y.

The photoreceptor 1Y is formed by stacking a photosensitive layer on a conductive substrate (volume resistivity at 20° C.: $1\times10^{-6}$ Ωcm or less). In the photosensitive layer, which is normally of high resistance (comparable with the resistance of ordinary resins), the specific resistance of the portion irradiated with the laser beam varies upon being irradiated with the laser beam 3Y. Thus, the exposure device 3 irradiates the surface of the charged photoreceptor 1Y with the laser beam 3Y on the basis of the image data of the yellow image sent from the controller (not shown). The photosensitive layer on the surface of the photoreceptor 1Y is irradiated with the laser beam 3Y, and thereby an electrostatic image of yellow printing pattern is formed on the surface of the photoreceptor 1Y.

The term "electrostatic image" herein refers to an image formed on the surface of the photoreceptor 1Y by charging, the image being a "negative latent image" formed by irradiating a portion of the photosensitive layer with the laser beam 3Y to reduce the specific resistance of the irradiated portion so that the charges on the irradiated surface of the photoreceptor 1Y discharges while the charges on the portion that is not irradiated with the laser beam 3Y remain.

The electrostatic image, which is formed on the photoreceptor 1Y as described above, is sent to the predetermined developing position by the rotating photoreceptor 1Y. The electrostatic image on the photoreceptor 1Y is visualized (developed) by the developing device 4Y at the developing position.

The developing device 4Y includes the electrostatic-image developer according to an exemplary embodiment, the developer including a yellow toner and a carrier. The yellow toner is stirred in the developing device 4Y to be charged by friction and supported on a developer roller (developer support), carrying an electric charge of the same polarity (negative) as the electric charge on the photoreceptor 1Y. The yellow toner is electrostatically adhered to the eliminated latent image portion on the surface of the photoreceptor 1Y as the surface of the photoreceptor 1Y passes through the developing device 4Y. Thus, the latent image is developed using the yellow toner. The photoreceptor 1Y on which the yellow toner image is formed keeps rotating at the predetermined rate, thereby transporting the toner image developed on the photoreceptor 1Y to the first transfer position.

Upon the yellow toner image on the photoreceptor 1Y reaches the first transfer position, first transfer bias is applied to the first transfer roller 5Y so as to generate an electrostatic force on the toner image in the direction from the photoreceptor 1Y toward the first transfer roller 5Y. Thus, the toner image on the photoreceptor 1Y is transferred to the intermediate transfer belt 20. The transfer bias applied here has the opposite polarity (+) to that of the toner (−) and controlled to be, for example, in the first unit 10Y, about +10 μA by a controller (not shown).

The toner remained on the photoreceptor 1Y is removed by the cleaning device 6Y to be collected.

The first transfer biases applied to first transfer rollers 5M, 5C, and 5K of the second, third, and fourth units 10M, 10C, and 10K are each controlled in accordance with the first unit 10Y.

Thus, the intermediate transfer belt 20, on which the yellow toner image is transferred in the first unit 10Y, is successively transported through the second to fourth units 10M, 100, and 10K while toner images of the respective colors are superimposed on top of another.

The intermediate transfer belt 20, on which toner images of four colors are multiple-transferred in the first to fourth units, is then transported to a second transfer unit including a support roller 24 being in contact with the intermediate transfer belt 20 and the inner surface of the intermediate transfer belt and a second transfer roller (second transfer unit) 26 disposed on the side facing the image-holding side of the intermediate transfer belt 20. A recording medium (body to be transferred to) P is fed by a feed mechanism into a narrow space between the second transfer roller 26 and the intermediate transfer belt 20 that are brought into contact with each other by pressure at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording medium P. Thus, the toner image on the intermediate transfer belt 20 is transferred to the recording medium P. The value of the second transfer bias is determined on the basis of the resistance detected by a resistance detector (not shown) that detects the resistance of the second transfer unit and voltage-controlled.

Subsequently, the recording medium P is transported into a nip part at which a pair of fixing rolls in the fixing unit (roll-shaped fixing unit) 28 are brought into contact with each other. The toner image is fixed to the recording medium P to form a fixed image.

Examples of the recording medium to which a toner image is transferred include plain papers used in, for example, electrophotographic copiers and printers, and OHP films.

In order to enhance the surface smoothness of the fixed image, the surface of the recording medium may be also smooth. Examples of the recording medium include coated papers produced by coating the surface of plain paper with resin or the like and art papers for printing.

The recording medium P, on which the color image has been fixed, is transported toward an exit portion. Thus, the series of the color image-forming operation are terminated.

Note that, although the toner image is transferred to the recording medium P through the intermediate transfer belt 20 in the above-described exemplary image-forming apparatus, the mechanism for transferring a toner image is not limited to this; the toner image may be directly transferred from the photoreceptor to the recording medium.

Process Cartridge and Toner Cartridge

Figure 2:
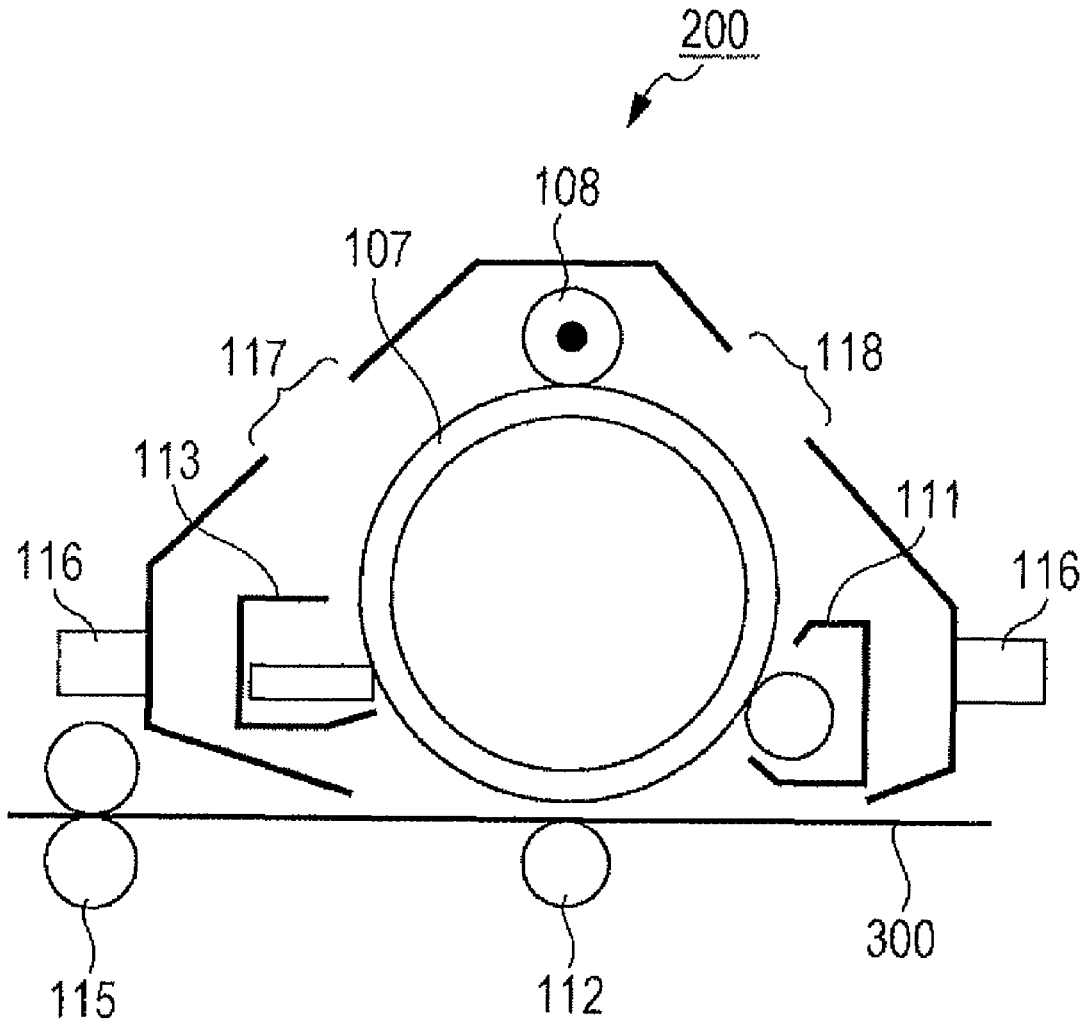
FIG. 2 is a schematic diagram illustrating a process cartridge according to an exemplary embodiment.

FIG. 2 is a schematic diagram illustrating an example of a process cartridge according to an exemplary embodiment, the process cartridge including an electrostatic-image developer according to an exemplary embodiment. A process cartridge 200 includes a photoreceptor 107, a charging roller 108, a developing device 111, a photoreceptor-cleaning device 113, an aperture for exposure 118, and an aperture for erasing exposure 117 that are combined in one unit using a mounting rail 116. In FIG. 2, reference numeral 300 denotes a recording medium.

The process cartridge 200 is detachably attached to an image-forming apparatus including a transfer unit 112, a fixing unit 115, and other components (not shown).

Although the process cartridge 200 shown in FIG. 2 includes the charging unit 108, the developing device 111, the cleaning device 113, the aperture for exposure 118, and the aperture for erasing exposure 117, these devices may be selectively combined. The process cartridge according to this exemplary embodiment includes, in addition to the photoreceptor 107, at least one selected from the group consisting of the charging unit 108, the developing device 111, the cleaning device (cleaning unit) 113, the aperture for exposure 118, and the aperture for erasing exposure 117.

The toner cartridge according to an exemplary embodiment will now be described. The toner cartridge according to this exemplary embodiment is detachably attached to an image-forming apparatus and including an electrostatic-image developing toner to be supplied to a developing unit disposed inside the image-forming apparatus.

The image-forming apparatus illustrated in FIG. 1 includes toner cartridges 8Y, 8M, 8C, and 8K detachably attached thereto. Developing devices 4Y, 4M, 4C, and 4K are each connected to the toner cartridge associated with each developing device (color) through a toner supply tube (not shown). The toner cartridge is exchanged when the amount of toner stored in the toner cartridge becomes small.

EXAMPLES

Hereafter, the exemplary embodiments are explained in detail with reference to Examples, but not limited thereto. In Examples, all parts and percentages are by mass unless otherwise indicated.

Example 1

Synthesis of Rosin Diol

Into a stainless reactor equipped with a stirrer, a heating unit, a cooling tube, and a thermometer, 200 parts of gum rosin, which serves as a rosin component, purified by distillation (distillation conditions: 6.6 kPa, 220° C.), 89 parts (1.05 moles relative to 2 moles of rosin compound) of bisphenol A diglycidyl ether (product name "jER828", produced by Mitsubishi Chemical Corporation) serving as a difunctional epoxy compound, and 0.4 parts of tetraethylammonium bromide (produced by Tokyo Chemical Industry Co., Ltd.) serving as a reaction catalyst are placed. The mixture is heated to 130° C. to undergo a ring-open reaction of acid groups of the rosin and epoxy groups of the epoxy compound. The ring-open reaction is continued at the temperature for 4 hours and terminated at the time when the acid value reaches 0.5 mg KOH/g. Thus, a mixture of the rosin diol (1) exemplified by the above-described exemplary compounds and the remaining difunctional epoxy compound (bisphenol A diglycidyl ether) is prepared.

Synthesis of Polyester

Into a stainless reactor equipped with a stirrer, a heating unit, a thermometer, a fractionating unit, and a nitrogen gas introduction tube, 250 parts of the mixture of the rosin diol (1) and the remaining difunctional epoxy compound; 25 parts of terephthalic acid (produced by Wako Pure Chemical Industries, Ltd.), 40 parts of dodecenyl succinic acid (produced by Tokyo Chemical Industry Co., Ltd.), and 33 parts of fumaric acid that serve as acid components; and 0.7 parts of tetra-n-butyl titanate (produced by Tokyo Chemical Industry Co., Ltd.) serving as a reaction catalyst are placed. The mixture is subjected to polycondensation for 7 hours at 230° C. in a nitrogen atmosphere with stirring. The polycondensation is terminated when the molecular weight and acid value reach intended values. Thus, polyester (1) is synthesized.

The weight-average molecular weight (Mw), number-average molecular weight (Mn), molecular-weight distribution (Mw/Mn), acid value, glass transition temperature (Tg), and softening temperature (FT 1/2 stroke temperature) are measured by the above-described methods.

Toner Particles 1

The following components are kneaded with an extruder and the resulting kneaded product is pulverized with a surface pulverization-type pulverizer. The pulverized product is then classified in terms of particle size with an air classifier (Turbo Classifier (TC-15N), produced by Nisshin Engineering Inc.) and the particles having a median size between fine and coarse particles are prepared. The classification is repeated three times. This process forms magenta toner particles 1 having a volumetric average particle diameter of 8 μm.

| | |
|---|---|
| Polyester (1) | 100 parts by mass |
| Magenta pigment (C.I. Pigment Red 57) | 3 parts by mass |
| Toner | |

Silica (0.5 parts by mass, product name: R812, produced by Nippon Aerosil Co., Ltd.) is added to the toner particles 1 (100 parts by mass) and mixed with a high-speed mixer to prepare a toner.

Developer

Seven parts by mass of the above-described toner is added to 100 parts by mass of ferrite carrier that is covered with a methyl methacrylate-styrene copolymer and has a diameter of 50 μm. These components are mixed with a tumbler shaker mixer to prepare a developer.

The environmental conditions for mixing the toner and the carrier are summer environmental conditions (30° C., relative humidity 85%) and winter environmental conditions (5° C., relative humidity 10%).

Evaluation

The toner and developer prepared as above are evaluated in terms of low-temperature fixability (minimum fixing temperature, fixability) and high temperature fixability (maximum fixing temperature, fixability).

Table 2 shows the results.

Minimum and Maximum Fixing Temperature

An image is formed on paper for color printing (J paper) produced by Fuji Xerox Co., Ltd. using the developer prepared as above with a modified DocuCentre Color 500 produced by Fuji Xerox Co., Ltd., which has been modified so as to allow an external fuser with controllable fixing temperature to perform fixation, so that the amount of toner loaded is 13.5 g/m$^2$. The formed image is then fixed to the paper using an external fuser with a nip width of 6.5 mm at a fixing rate of 180 mm/sec.

In order to evaluate the minimum and maximum fixing temperatures, the fixing is carried out under various conditions by increasing the preset temperature of the fixing roller of the external fuser in steps of +5° C. from 90° C. For each paper on which an image has been formed at a different fixing temperature, a fold line is formed at the center of the solid portion of the fixed toner image, a portion in which the fixed toner image is damaged is wiped with a tissue, and the width of the resulting white streak is measured. The minimum and maximum temperatures at which the width is 0.5 mm or less are defined as the minimum fixing temperature (MFT) and the maximum fixing temperature, respectively.

The fixing latitude is determined on the basis of the minimum fixing temperature and maximum fixing temperature.

Fixability

Print test charts with an area coverage of 1% are formed on color-printing paper (10,000 sheets, J paper, produced by Fuji Xerox Co., Ltd.) at 28° C. and a relative humidity of 85% using the above-mentioned modified DocuCentre Color 500 produced by Fuji Xerox Co., Ltd. with the developer prepared as described above.

The fixing temperature is set to a temperature higher than the minimum fixing temperature (MFT) determined above by 30° C.

After the image forming with 10,000 sheets, the surface of the fixed image is visually inspected to determine whether streaking marks caused by feed rollers are present in accordance with the following criteria.

In the evaluation results, the developers evaluated as A and B are considered to have few problems for practical use.

A: Streaking roller marks are absent.

B: Streaking roller marks are absent up to printing of 9,000 sheets, but slightly visible after printing of 10,000 sheets.

C: Streaking roller marks are slightly visible after printing of 5,000 sheets.

D: Streaking roller marks are clearly visible after printing of 5,000 sheets.

Example 2

A toner and a developer are prepared as in Example 1, except that the amount of difunctional epoxy compound used for the synthesis of a rosin diol is 1.23 moles relative to 2 moles of rosin compound and the synthesis time for the synthesis of a polyester is 6.5 hours.

Example 3

A toner and a developer are prepared as in Example 1, except that the amount of difunctional epoxy compound used for the synthesis of a rosin diol is 1.02 moles relative to 2 moles of rosin compound and the synthesis time for the synthesis of a polyester is 8 hours.

Example 4

A toner and a developer are prepared as in Example 1, except that the amount of difunctional epoxy compound used for the synthesis of a rosin diol is 1 mole relative to 2 moles of rosin compound and 0.015 moles of a difunctional epoxy compound is further added as a crosslinking agent for the synthesis of a polyester.

Comparative Example 1

A toner and a developer are prepared as in Example 1, except that the amount of difunctional epoxy compound used for the synthesis of a rosin diol is 1.0 moles relative to 2 moles of rosin compound and the synthesis time for the synthesis of a polyester is 9 hours.

TABLE 2

| | Evaluation | | | |
|---|---|---|---|---|
| | Minimum fixing temperature [° C.] | Maximum fixing temperature [° C.] | Fixing latitude | Fixability |
| Example 1 | 145 | 195 | 50 | A |
| Example 2 | 150 | 190 | 40 | A |
| Example 3 | 145 | 190 | 45 | B |
| Example 4 | 155 | 195 | 40 | B |
| Comparative example 1 | 160 | 195 | 35 | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A polyester being a polymer including a dicarboxylic acid, a rosin diol, and an epoxy compound, the rosin diol being represented by general formula (1):

(1)

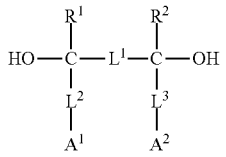

wherein $R^1$ and $R^2$ are independently hydrogen or methyl; $L^1$, $L^2$, and $L^3$ are independently a divalent linking group selected from the group consisting of carbonyl, ester, ether, sulfonyl, optionally substituted chain alkylenes, optionally substituted cyclic alkylenes, optionally substituted arylenes, and combinations thereof; $L^1$ and $L^2$ or $L^1$ and $L^3$ are optionally joined together to form a ring; and $A^1$ and $A^2$ are rosin ester groups.

2. The polyester according to claim 1, wherein the epoxy compound is a difunctional epoxy compound.

TABLE 1

| | Synthesis of rosin diol | | Synthesis of polyester | Physical properties | | | | | |
|---|---|---|---|---|---|---|---|---|---|
| | Rosin compound | Difunctional epoxy | Difunctional epoxy | Mw | Mn | Mw/Mn | Acid value [mg KOH/g] | Tg [° C.] | FT ½ stroke temperature [° C.] |
| Example 1 | 2 mol | 1.05 mol | 0 mol | 50,000 | 4,000 | 12.5 | 15.0 | 62.5 | 107 |
| Example 2 | 2 mol | 1.23 mol | 0 mol | 59,000 | 7,000 | 8.4 | 11.5 | 63.1 | 110 |
| Example 3 | 2 mol | 1.02 mol | 0 mol | 55,000 | 3,900 | 14.1 | 12.7 | 59.9 | 105 |
| Example 4 | 2 mol | 1 mol | 0.015 mol | 50,000 | 5,100 | 9.8 | 14.6 | 63.0 | 112 |
| Comparative example 1 | 2 mol | 1 mol | 0 mol | 40,000 | 11,400 | 3.5 | 10.8 | 68.2 | 124 |

3. The polyester according to claim 1, wherein the polyester has a crosslinked structure formed by the epoxy compound.

4. The polyester according to claim 1, wherein the epoxy compound is a compound selected from the group consisting of diglycidyl ethers of aromatic diols, diglycidyl ethers of aromatic dicarboxylic acids, diglycidyl ethers of aliphatic diols, diglycidyl ethers of alicyclic diols, and alicyclic epoxides.

5. The polyester according to claim 1, wherein the rosin diol represented by general formula (1) is a reaction product produced by reacting a rosin compound with an epoxy compound, the molar ratio of the rosin compound to the epoxy compound being about 2:1.01 to about 2:1.2, and the polymer is produced by polymerization of the dicarboxylic acid and the reaction product.

6. The polyester according to claim 1, wherein a molecular-weight distribution (Mw/Mn) calculated from a weight-average molecular weight Mw and a number-average molecular weight Mn is about 12 or more.

7. An electrostatic-image developing toner including the polyester according to claim 1.

8. An electrostatic-image developer including the electrostatic-image developing toner according to claim 7.

9. A toner cartridge including the electrostatic-image developing toner according to claim 7, the toner cartridge being detachably attached to an image-forming apparatus.

10. A process cartridge including a developing unit that includes the electrostatic-image developer according to claim 8 and develops an electrostatic image formed on a surface of an image-carrying member with the electrostatic-image developer to form a toner image, the process cartridge being detachably attached to an image-forming apparatus.

11. An image-forming apparatus comprising:

an image-carrying member;

a charging unit that charges a surface of the image-carrying member;

an electrostatic-image forming unit that forms an electrostatic image on the surface of the image-carrying member;

a developing unit including the electrostatic-image developer according to claim 8, the developing unit developing the electrostatic image with the electrostatic-image developer to form a toner image;

a transfer unit that transfers the toner image to a recording medium; and a fixing unit that fixes the toner image to the recording medium.

12. An image-forming method comprising:

charging a surface of an image-carrying member;

forming an electrostatic image on the surface of the image-carrying member;

developing the electrostatic image with the electrostatic-image developer according to claim 8 to form a toner image;

transferring the toner image to a recording medium; and fixing the toner image to the recording medium.

* * * * *